US011707085B2

(12) United States Patent
Armoush et al.

(10) Patent No.: US 11,707,085 B2
(45) Date of Patent: Jul. 25, 2023

(54) INDUCTIVE HEATING APPARATUS AND RELATED METHOD

(71) Applicant: Wallbrooke Investments Ltd., Tortola (VG)

(72) Inventors: Mohannad A. Armoush, Amman (JO); Björn Sauer, Bern (CH); Martin Ziegler, Bern (CH)

(73) Assignee: EVYRA SA, Geneva (CH)

( * ) Notice: Subject to any disclaimer, the term of this patent is extended or adjusted under 35 U.S.C. 154(b) by 634 days.

(21) Appl. No.: 16/750,527

(22) Filed: Jan. 23, 2020

(65) Prior Publication Data

US 2020/0205470 A1 Jul. 2, 2020

Related U.S. Application Data

(62) Division of application No. 15/411,608, filed on Jan. 20, 2017, now Pat. No. 10,561,172.

(60) Provisional application No. 62/382,704, filed on Sep. 1, 2016, provisional application No. 62/304,872, filed on Mar. 7, 2016.

(51) Int. Cl.

| | |
|---|---|
| ***A24F 1/30*** | (2006.01) |
| ***H05B 6/10*** | (2006.01) |
| ***H05B 6/06*** | (2006.01) |
| ***A24F 40/40*** | (2020.01) |
| ***A24F 40/465*** | (2020.01) |
| ***A24F 40/51*** | (2020.01) |
| *A24F 40/10* | (2020.01) |
| *A24F 40/20* | (2020.01) |

(52) U.S. Cl.

CPC ..... *A24F 1/30* (2013.01); *A24F 40/40* (2020.01); *A24F 40/465* (2020.01); *A24F 40/51* (2020.01); *H05B 6/06* (2013.01); *H05B 6/105* (2013.01); *A24F 40/10* (2020.01); *A24F 40/20* (2020.01)

(58) Field of Classification Search

None

See application file for complete search history.

(56) References Cited

U.S. PATENT DOCUMENTS

| | | | |
|---|---|---|---|
| 4,821,747 | A | 4/1989 | Stuhl |
| 5,148,801 | A | 9/1992 | Douwens |
| 5,819,756 | A | 10/1998 | Mielordt |
| 6,234,167 | B1 | 5/2001 | Cox |

(Continued)

FOREIGN PATENT DOCUMENTS

| | | | |
|---|---|---|---|
| CN | 104095291 A | * | 10/2014 |
| CN | 104095291 A | | 10/2014 |

(Continued)

OTHER PUBLICATIONS

Machine translation of CN104095291 A, European Patent office, 2022 [online], retrieved on Aug. 11, 2022]. Retrieved from the Internet: <URL: https://worldwide.espacenet.com>. (Year: 2022).*

(Continued)

*Primary Examiner* — Dennis R Cordray

(74) *Attorney, Agent, or Firm* — Finnegan, Henderson, Farabow, Garrett & Dunner LLP

(57) ABSTRACT

A heating apparatus for heating a cavity inside a chamber. The apparatus may include a first heater at the bottom of the chamber, a second heater at the top of the chamber, at least one air inlet connected to the chamber; and at least one air outlet connected to the chamber.

18 Claims, 15 Drawing Sheets

(56) References Cited

U.S. PATENT DOCUMENTS

| | | | |
|---|---|---|---|
| 6,501,052 | B2 | 12/2002 | Cox |
| 7,537,009 | B2 | 5/2009 | Hale |
| 7,589,301 | B2 | 9/2009 | Seok |
| 7,619,188 | B2 | 11/2009 | Oghafua et al. |
| 7,775,218 | B2 | 8/2010 | Shraiber |
| 7,802,569 | B2 | 9/2010 | Yeates |
| 7,829,827 | B2 | 11/2010 | Rosenbloom et al. |
| 8,080,477 | B2 | 12/2011 | Nodera |
| 8,459,289 | B2 | 6/2013 | Zoumut |
| 8,490,630 | B2 | 7/2013 | Boutros |
| 9,000,335 | B2 | 4/2015 | Rosenbloom et al. |
| 9,237,770 | B2 | 1/2016 | Bavar |
| D760,430 | S | 6/2016 | Hanna |
| 9,433,241 | B2 | 9/2016 | Jalloul et al. |
| 2006/0021573 | A1 | 2/2006 | Monsma |
| 2007/0058599 | A1 | 3/2007 | Zoumut |
| 2007/0178669 | A1 | 8/2007 | Noda |
| 2008/0060663 | A1 | 3/2008 | Hamade et al. |
| 2009/0178836 | A1 | 7/2009 | Nefraoul |
| 2010/0066619 | A1 | 3/2010 | Furumura et al. |
| 2010/0126518 | A1 | 5/2010 | Saleh |
| 2010/0262057 | A1 | 10/2010 | Saleh |
| 2011/0186061 | A1 | 8/2011 | Saleh |
| 2011/0188080 | A1 | 8/2011 | Saleh |
| 2011/0210117 | A1* | 9/2011 | Yonenaga ..... C23C 16/46 219/634 |
| 2012/0294595 | A1 | 11/2012 | Veltrop |
| 2014/0069446 | A1 | 3/2014 | Haddad |
| 2014/0091083 | A1 | 4/2014 | McGarvey |
| 2014/0209098 | A1 | 7/2014 | Dunn et al. |
| 2015/0053221 | A1 | 2/2015 | Asghar-Sheikh et al. |
| 2015/0264752 | A1 | 9/2015 | Rosenbloom et al. |
| 2015/0320116 | A1 | 11/2015 | Bleloch et al. |
| 2016/0188762 | A1 | 7/2016 | Warrier |
| 2016/0206001 | A1 | 7/2016 | Eng et al. |
| 2016/0165951 | A1 | 8/2016 | Gupta |
| 2016/0249677 | A1 | 9/2016 | Bishara |

FOREIGN PATENT DOCUMENTS

| | | | |
|---|---|---|---|
| EP | 1941806 | A1 | 7/2008 |
| EP | 1702525 | B1 | 10/2009 |
| EP | 2179667 | B1 | 4/2014 |
| EP | 2719294 | A1 | 4/2014 |
| EP | 2845497 | A1 | 3/2015 |
| WO | WO 2006/085126 | A1 | 8/2006 |
| WO | WO 2006/124051 | A2 | 11/2006 |
| WO | WO 2007/ 524008 | A2 | 11/2007 |
| WO | WO 2009/088621 | A1 | 7/2009 |
| WO | WO 2010/093782 | A1 | 9/2010 |
| WO | WO 2012/171634 | A1 | 12/2012 |
| WO | WO 2013/007948 | A1 | 1/2013 |
| WO | WO 2013/184847 | A1 | 12/2013 |
| WO | WO 2014/098636 | A1 | 8/2014 |
| WO | WO 2014/118787 | A1 | 8/2014 |
| WO | WO 2015/097424 | A1 | 7/2015 |
| WO | WO 2015/010349 | A1 | 1/2016 |
| WO | WO 2016/040530 | A1 | 3/2016 |
| WO | WO 2016/082851 | A1 | 6/2016 |
| WO | WO 2016/099588 | A1 | 6/2016 |
| WO | WO 2016/090962 | A1 | 8/2016 |
| WO | WO 2016/019573 | A1 | 2/2018 |

OTHER PUBLICATIONS

International Search Report, and Written Opinion from the International Search Authority, dated Mar. 29, 2017, in corresponding Application No. PCT/IB2017/000062,14 pages.

Communication from the European Patent Office, dated Jun. 4, 2017, in corresponding Application No. EP 17153575, 8 pages.

SideKick Personal Vaporizer: *The Future is Here*: http://7thfloorvapes.com/index.php/seventhfloorvapes/vaporizers/handheld/sidekick.html; pp. 11.

Aspire Proteus: http://www.aspirecig.com/products/E-hookah/227.htm; pp. 8.

Boge: E-Hookah/T903 E-Shisha; www.bogecig.com: pp. 2.

Hauni Körber Solutions: *Shisha capsules: the future of shisha smoking*; 1 page.

Ngensmoke™: Remix Electronic Hookah; contact info@ngensmoke.com; pp. 5.

Nuvo: NuvoCig E-Hooka Converter Kit; 2016 NuvoCig. 1 page.

Platinum Puffs: Hookah Bowl Conversion Kit: http://platinumepuffs.com/vaporizers/hookah-bowl-convertor/hookah-bowl.html. *Wisitech*; 2014-16 Platinum E Puffs, LLC.; pp. 5.

Shishapresso®: http://www.shishapresso.com/content/prepare-your-shisha-3-easy-steps; 2014 Shishapresso S.A.L.; pp. 2.

Minos—The Vapiking Taste King—Smok®: *Being with you for all great vaping time*; http://www.smoktech.com/atomizer/minos; pp. 22.

* cited by examiner

INDUCTIVE HEATING APPARATUS AND RELATED METHOD

CROSS REFERENCE TO RELATED APPLICATIONS

This application is a divisional of application Ser. No. 15/411,608, filed Jan. 20, 2017, which claims the benefit of priority to U.S. Provisional Patent Application No. 62/304,872, filed Mar. 7, 2016 and titled "SELF CLEANING BATTERY OPERATED HOOKAH", and to U.S. Provisional Application No. 62/382,704, filed Sep. 1, 2016 and titled "SELF CLEANING BATTERY OPERATED HOOKAH". The disclosures of the above-referenced applications are incorporated herein by reference in their entireties.

TECHNICAL FIELD

The present disclosure relates generally to heating apparatus and methods, and more particularly, to heating apparatus and methods to vaporize smokable materials.

BACKGROUND

Hookahs (also known as water pipes, narghile, bongs, hubble-bubble, and shishas), are instruments used to vaporize and smoke various substances, including tobacco, flavored tobacco, shisha, or mu'assel. In traditional hookahs the substance is vaporized in a bowl located at the top of the instrument. The vapor then travels through a stem into a water reservoir and is inhaled by a user with a hose connected to the water reservoir. When the user inhales the vapor, pressure changes in the water reservoir forces more vapor from the bowl through the stem into the water reservoir continuing the process.

Regular operation of hookahs requires placing burning charcoals close to the bowl, normally on top of it, to transfer heat required to vaporize the substance that is inhaled. However, the use of burning charcoals as heat source in hookahs has several drawbacks. For example, water does not filter many toxic chemicals that are released during charcoal burning exposing smokers to dangerous chemicals. These substances may increase the risk of diseases and may reduce lung function. Burning charcoal releases high levels of carbon monoxide (CO), metals, and various carcinogenic substances that are not filtered by water in the reservoir. In addition, charcoal burning increases the amount of CO and carbon dioxide ($CO_2$) in the environment. Large levels of carbon increase the probability of carboxyhemoglibin formation in the blood, reduction of oxygen carry capacity, and CO poisoning. Furthermore, coal burning exposes nonsmokers to second hand smoke, has an unpleasant smell, and represent fire hazards.

The disclosed heating apparatus and methods are directed to mitigating or overcoming one or more of the problems set forth above and/or other problems in the prior art.

SUMMARY

One aspect of the present disclosure is directed to a heating apparatus for heating a cavity inside a chamber. The apparatus may include a first heater at the bottom of the chamber, a second heater at the top of the chamber, at least one air inlet connected to the chamber, and at least one air outlet connected to the chamber.

Another aspect of the present disclosure is directed to a method of heating a material inside a chamber. The method may include: heating the material to a basic temperature with a first heater in the bottom of the chamber, heating air flowing through an air inlet connected to the chamber with a second heater, and heating the material to a processing temperature with the heated air.

Yet another aspect of the present disclosure is directed to an induction heating system. The system may include: a chamber comprising a top piece and a bottom piece, a first heater in contact with the bottom piece, and a second heater in contact with the top piece.

Other aspects of the present disclosure is directed to a capsule for heating a material contained within the capsule. The capsule may include: a top piece, a bottom piece, and a body. The top piece and the bottom piece may close the body creating a cavity. The cavity may be filled with smokable, medicinal, or aromatic materials, among others.

Yet another alternative aspect of the present disclosure is directed to a hookah system. The system may include: a reservoir, a hose connected to the reservoir, a stem connected to a chamber and the interior of the reservoir, a first heater in the bottom of the chamber, and a second heater in the top of the chamber.

DETAILED DESCRIPTION

The disclosure is generally directed to heating apparatus, such as a hookah, and methods that may facilitate operation of instruments to vaporize materials, by improving their efficiency and reducing associated risks. The disclosed embodiments are also directed to hookah systems and methods that minimize CO emission. Substitution of traditional coal burning with electrical heating, may reduce the hookah's emission of toxic gases to less than 10%. In some embodiments, the heating apparatus may include a chamber with a plurality of electrical heaters arranged in different positions around and/or inside the chamber. Each one of the plurality of heaters may be independently powered and controlled to enable heating protocols that make the heating process more efficient. In some embodiments, the heating apparatus may use different working principles to minimize risks or optimize power transfer. For example, the heating apparatus may use inductive heating to directly heat the substance to be vaporized and minimize health and fire hazards. Additionally or alternatively, the chamber may include air inlets and air outlets used to promote air exchanges and controllers that adjust power delivered to heaters. Also, air inlets may ease convection heating by injecting hot air into the chamber and can include sensors to monitor the temperature during drag cycles, with a drag cycle consisting of air exchanges in the chamber. For example, a drag cycle may be triggered by a user inhaling through a hose, forcing an air exchange in the chamber. A drag cycle may also be induced by a pump or motor.

The disclosure is additionally directed to capsules containing smokable or vaporizable materials. The capsule may be configured to be housed inside the heater chamber and may be designed to facilitate operation of the heater apparatus. For example, the capsule may be configured to be inserted in the chamber and may include multiple independent portions that create a cavity when they are assembled. The capsules may be designed with the aim to utilize multiple capsules simultaneously within the chamber. Additionally, the capsule may have a plurality of shapes. Further, the capsule may be disposable or reusable, and may be metallic, and contain a variety of materials that can be processed with the heating apparatus.

The disclosure is also directed to a hookah system. In some embodiments, in addition to a heating apparatus, the hookah system may include a reservoir, stems, and a hose. The hookah system may additionally incorporate controllers, battery systems, and power connectors, to deliver power to the heaters. In some embodiments, the hookah system may also include other devices to facilitate a smoking session, simplify the system's assembly, or aid in post-smoking routines (i.e. cleaning methods).

Figure 1A:
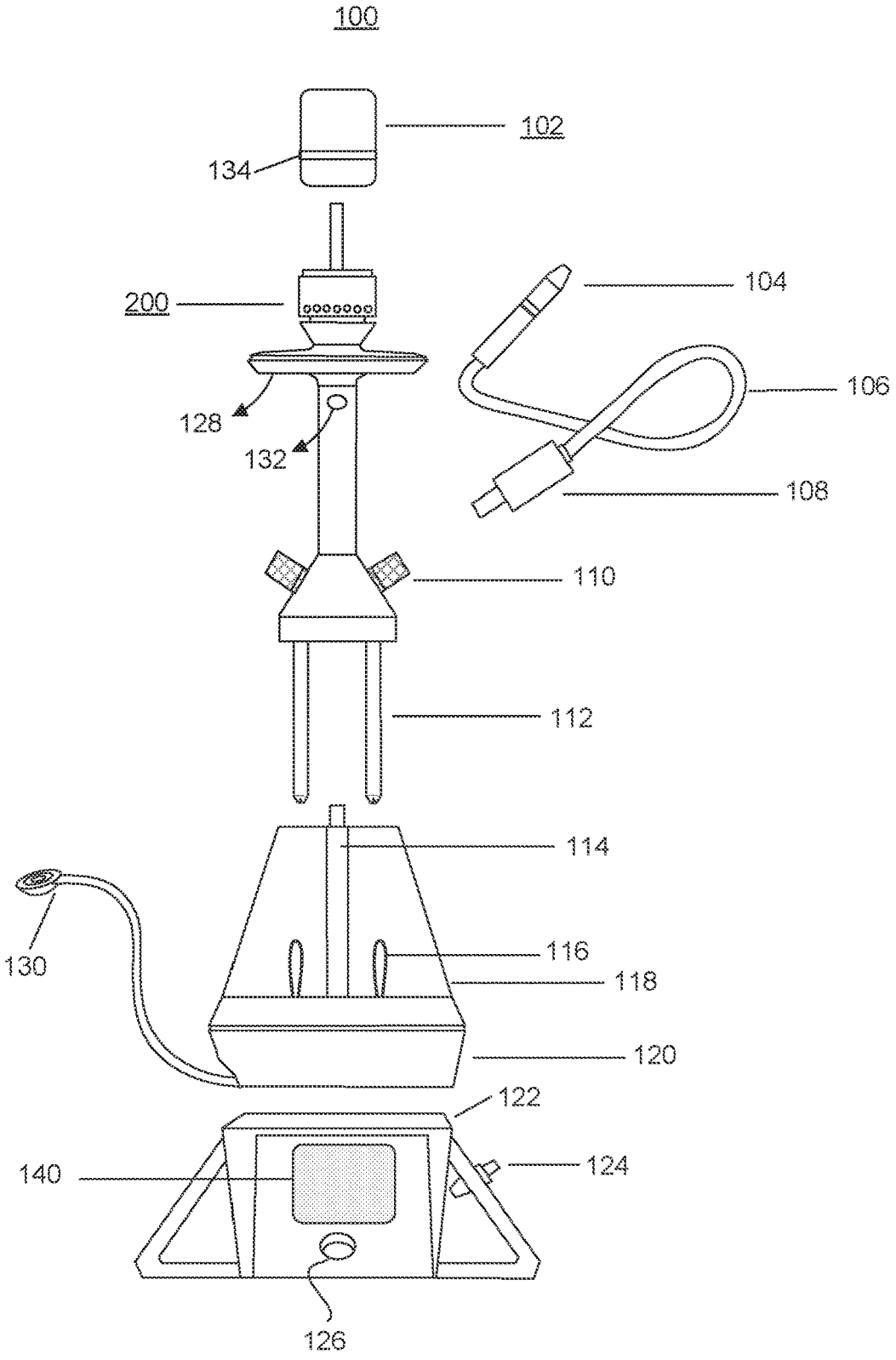
FIG. 1A is a diagrammatic illustration of an exemplary hookah, according to an embodiment of the disclosure.

FIG. 1A is a diagrammatic illustration of an exemplary hookah, according to an embodiment of the disclosure. Hookah 100 may include top, middle, and bottom sections. The top section of hookah 100 may include a cover 102, a heating apparatus 200, a holder 128, a hose connector 110, a carbon monoxide detector 132, LED indicator 134, and stems 112. The middle section of hookah 100 may include a power connector 114, water heaters 116, a reservoir 118, charger cable 130, and a battery system 120. The bottom section of hookah 100 may include a charging docket 122, a mouth tip dock 124, control buttons 126, and display 140. In addition, hookah 100 may include hose 106, which may be connected to a mouth tip 104, and a replaceable filter 108. Mouth tip 104 may be magnetic, so that it may rest on holder 128, which may also be magnetized, during non-operation. Charger cable 130 may also be magnetic, as may its connection to the charging docket 122.

Cover 102 may be a solid concave piece shaped to cover heating apparatus 200. In some embodiments, cover 102 may be porous to allow airflow. In such embodiments cover 102 may have air holes in, for example, the top surface. Alternatively cover 102 may be formed with a porous material, such a mesh or a porous plastic. In other embodiments cover 102 may be made of glass, metals, ceramics, and/or plastics. Then, cover 102 may include air openings such as vertical or horizontal slits to enable air circulation. Alternatively or additionally, cover 102 may have a geometry that prevents a full seal to facilitate air flow. For example the bottom of cover 102 contacting hookah 100 can be curved to create openings.

Hose connector 110 may be a solid piece with a complementary shape to filter 108. In some embodiments hose connector 110 may be a male or female threaded fastener. Alternatively, hose connector 110 may be an adapter with a locking geometry complementary to filter 108. In alternate embodiments hose connector 110 may include a Luer-lok, an auto seal hose adapter, an Egyptian hookah hose adapter, a Mya hookah hose adapter, or any other suitable connector or fastener that secures holder replaceable filter 108 with the body of hookah 100.

Stems 112 may be any tube of a solid material capable of conducting air from heating apparatus 200 to reservoir 118. In some embodiments stems 112 may be a rigid hollow rod connecting creating an air pathway between the top and middle sections of hookah 100. For example, stem 112 may be a hollow metal rod with diameter of 16 mm and a length of 200 mm. In other embodiments, stems 112 may be a flexible tube creating an air pathway between heating apparatus 200 and reservoir 118. For example, tygon, acrylic, vinyl, epoxy, or polycarbonate tubes may be used for stems 112. In addition, stems 112 may be a single tube or a plurality of tubes, as presented in FIG. 1A. Moreover, in some embodiments stems 112 may be fragmented in multiple sections connected with mechanical joints, fittings, and or fasteners. In such embodiments, stems 112 may be assembled for a smoking session and disassembled for cleaning and/or storage.

Carbon monoxide detector 132 may be an opto-chemical sensor power, for example, by battery system 120 and configured to emit an alarm for a specific threshold. Alternatively, carbon monoxide detector 132 may be electrochemical and include reading circuitry to correlate currents with CO in the environment. Additionally, carbon monoxide detector 132 may be a solid state sensor and may include multiple sensing units. In some embodiments, carbon monoxide detector 132 may also include other air pollution sensors. For example, carbon monoxide detector 132 may include ozone, particulate matter, sulfur, dioxide, and nitrous oxide sensors that monitor surrounding air. Additionally, carbon monoxide detector may be configured to detect toxic gases such as hydrogen cyanide or sulfur nitrate, and may include user interfaces to communicate with a user.

Power connector 114 may be a rigid rod enclosing wires to transmit electrical power. Power connector 114 may include a mechanical connector that secures the rod to, for example, battery system 120. Power connector 114 may also include positive and negative contact changing points and an insulator, such as a dielectric polymer, between the contacts. In some embodiments, power connector 114 may have a coaxial configuration involving a central and an exterior contact isolated by a dielectric insulator. In such embodiments, the center core, dielectric insulator, and metallic shield, may be covered with a plastic jacket. In other embodiments, power connector 114 may be coated with an insulating layer. For example, power connector 114 may be covered in silicon gels and/or impermeable polymers that not only prevent electrical conduction but also impede liquid leaks that may short the terminals. In alternative or additional embodiments, power connector 114 may be a hollow rod protecting internal cabling. In such embodiments power cables and/or communications cables may be inside the hollow rod and connect to terminals of other components of hookah 100.

Hookah 100 may also have water heater 116 inside reservoir 118, as presented in FIG. 1A. Alternatively, water heater 116 may be in in thermal contact with reservoir 118. Water heater 116 may be a resistive heater, a Peltier heater, a coil, a microwave heater, or any kind of heater capable of increasing the temperature of water. Water heater 116 may be controlled with a button, for example buttons 126, and may be powered according to a cleaning protocol executed by a controller. In the cleaning process water heater 116 may heat up water to generate steam which is then directed to stems 112 and hose 106 to disinfect, clean, and/or sterilize elements of hookah 100.

Reservoir 118 may be a hollow solid container capable of holding liquids. Reservoir 118 may be made of glass, metals, or plastic. It may be formed by a plurality of modules confining water in different sections or it may be a single piece with different shapes. In some embodiments, the reservoir may have a cylindrical shape and have a hole in the section closest to the top portion that accommodates other elements of hookah 100, such as power connector 114. In other embodiments reservoir 118 may be a torus surface, a pyramid, or other structure. In addition, reservoir 118 may have a shape complementary to battery system 120, to facilitate connections. Alternatively, reservoir 118 may be attached to battery system 120 or battery system 120 may be embedded in reservoir 118.

Battery system 120 may include a plurality of unit cells connected in series or parallel to output terminals. Each unit cells may include a nickel-metal-hydride cell or a lithium-ion cell. Also, an electric double layer capacitor may be used in place of a unit cell. In some embodiments, battery system 120 may have all unit cells connected together, but alternative embodiments may have battery system 120 with two or more unit cells connected in parallel.

Battery system 120 may include a monitoring unit that detects input voltage values, during for example charging cycles, and detects output values during discharges. The monitoring unit may also estimate the level of charge in the unit cells and may be in communication with a user interface. In some embodiments, battery system 120 may include a temperature sensor that detects the temperature battery system 120, and outputs the detection result. In addition, a current sensor may detect battery system 120 current output and may control a circuit breaker to prevent large loads damaging the unit cells.

A positive line PL may be connected to a positive terminal of the battery system 120, and a negative line NL is connected to a negative terminal of battery system 120. Battery system 120 may be connected to a rectifier, via the positive line PL and the negative line NL. Also, a system main relay is provided in the positive line PL, and a system main relay SMR-G is provided in the negative line NL. The system main relays SMR-B, SMR-G may be switched between ON and OFF, in response to a drive signal when heating apparatus 200 is operated.

A booster circuit (not shown) may be provided in a current channel between the battery system 120 and the AC/DC converter. The booster circuit boosts or raises the voltage to, for example, increase charge rate. Also, the booster circuit can lower the output voltage of the AC/DC converter 23, and deliver electric power having the lowered voltage to the battery system 120 for example, when heating apparatus 200 is in a standby mode.

Battery system 120 may also include a case to hold and protect unit cells. The case may be configured to fit and attach to charging docket 122 with a swap out mechanism. In some embodiments, the swap out mechanism facilitates assembly of battery system 120 and charging docket 122. For example, the swap out mechanism may have hooks and springs in the battery system 120, and complementary holes and receptors in charging docket 122. Then, when holes are aligned and hooks are secured, charging docket 122 is connected to battery system 120 completing a circuit that may power elements of hookah 100. In addition, the swap out mechanisms may include components that create a seal between elements of hookah 100. For example, the interface of charging docket 122 and battery system 120 may include an O-ring that creates a waterproof seal to protect unit cells. In other embodiments the swap out mechanism may include sliding or magnetic components that secure the battery system 120 with charging docket 122. The swap out mechanism may also include a release button, that for example, may move hooks into a non-attached position, turn off power to eliminate force of magnetic components or release the springs securing the two components. Battery system 120 may also be made with water-resistant materials, or encased in water-resistant casing.

In alternative embodiments, battery system 120 is embedded in hookah 100. For example, it may be part of the base of reservoir 118 or it may be enclosed in the middle section of hookah 100. In addition, some embodiments may have the charging docket 122 and battery system 120 as a single element and have the swap out mechanism between other elements. For example, some embodiments may have the swap out mechanism between reservoir 118 and battery system 120.

In certain embodiments, electronic elements described for battery system 120 may also be in charging docket 122, leaving only unit cells in the battery system 120. In addition, charging docket 122 may be in contact with charger cable 130. Charger cable 130 may be a regular AC power plug. In other embodiments, however, charger cable 130 may be a magnetic charger with the electronic components necessary to induce a charging voltage. In both cases, charger cable 130 transmits power to the charging docket 122, which may in turn deliver the power to battery system 120 via, for example, connectors of the swap out mechanism. Alternative embodiments may include a power input directly into charging docket 122. For example, charging docket 122 may include a DC power connector (i.e. Molex, cylindrical, or snap and lock connectors), or an AC connector to be connected to an adapter or charger. Embodiments presented in FIG. 1A show charger cable 130 in the bottom section of hookah system 100. However, alternative embodiments may have charger cable 130 in the middle or top sections of hookah system 100 attached to other components of hookah system 100 and electrically connected to battery system 120 with different wired or wireless components.

Hookah 100 may also include at least one mouth piece dock 124, which may be a metal with a complementary shape to mouth tip 104. Mouth piece dock 124 may be embedded to hookah 100 or may be secured to hookah 100.

Hookah 100 may also include at least one hose 106. In some embodiments, hose 106 may be a silicone hose or a Nammor hose, including flexible washable rubber. In addition, hose 106 may include a handle made of plastic or textiles. Hose 106 may have a length ranging between 64 to 70 inches and include a 12 inch handle.

In certain embodiments, hookah 100 may also include display 140. Display 140 may include, for example, liquid crystal displays (LCD), light emitting diode screens (LED), organic light emitting diode screens (OLED), a touch screen, and other known display devices. Display 140 may present information to a user or also show a graphical user interface (GUI). For example, display 140 may display an interactive interface to operate heating apparatus 200 and perform certain aspects of the disclosed methods. Display 140 may show touchable or selectable options for a user, and may receive user selection of options through a touch screen or I/O devices. In addition, display 140 may enable and/or disable the operation of heating apparatus 200. For example, display 140 may display a graphical user interface with a parental control application. Then, the operation of heating apparatus 200 may require a user to input passwords into display 140 or conduct other identification processes, such as scanning valid fingerprints. The parental control application may alternatively consist of a number pad or scanner in the event a display similar to display 140 is not used.

Furthermore, display 140 may serve as a user interface with a controller connected to other elements of hookah 100. For example, in some embodiments a controller may be connected to speakers in hookah 100. In such embodiments, display 140 may show a GUI of a multi-media play list. Then a user may select and play music or videos by interacting with display 140 and controlling embedded, attached, or externally connected speakers. In certain embodiments the speakers may be coupled to display 140. In addition, in some embodiments display 140 may present interfaces to control other devices associated with hookah 100. For example, display 140 may present interfaces associated with battery system or LED 134. In such embodiments, electronic devices may communicate with a controller via communication cables, wired or wireless networks such as radio waves, a nationwide cellular network, and/or a local wireless network (e.g., Bluetooth™ or WiFi), or other communication methods. Then, the controller may instruct display 140 to present interfaces that collect user input or show information of elements in hookah 100. For example, display 140 may show the charge level of battery system 120 or the temperature or usage time of heating apparatus 200. Display 140 may also show a control menu so the user can adjust parameters such as temperature via the controller.

Hose 106 may be connected to mouth piece 104. Mouth piece 104 may be made of stainless steel, an acrylic, or other plastic embossed in the shape of the mouth piece. In other embodiments mouth piece 104 may be made of a freezable material. In yet other embodiments, mouth tip 104 may additionally incorporate ferrous materials which may attach to holder 128. In such embodiments, holder 128 may also include ferrous material of opposite magnetic polarity to the material in holder mouth tip 128. However, holder 128 may also be a tray where mouth tip 104 rests or may include mechanical holders, such as hooks or clamps, that secure mouth tip 104. Other embodiments include hookah 100 having a plurality of hoses to be connected to a plurality of hose connectors.

Hose 106 may also be connected to filter 108. As previously disclosed, filter 108 may be complementary to the hose connector 110, mirroring the threads or securing features. In some embodiments, filter 108 may include a carbon activated filter. Alternatively the filter may include cellulose acetate, CO filters, and/or $CO_2$ filters.

Figure 1B:
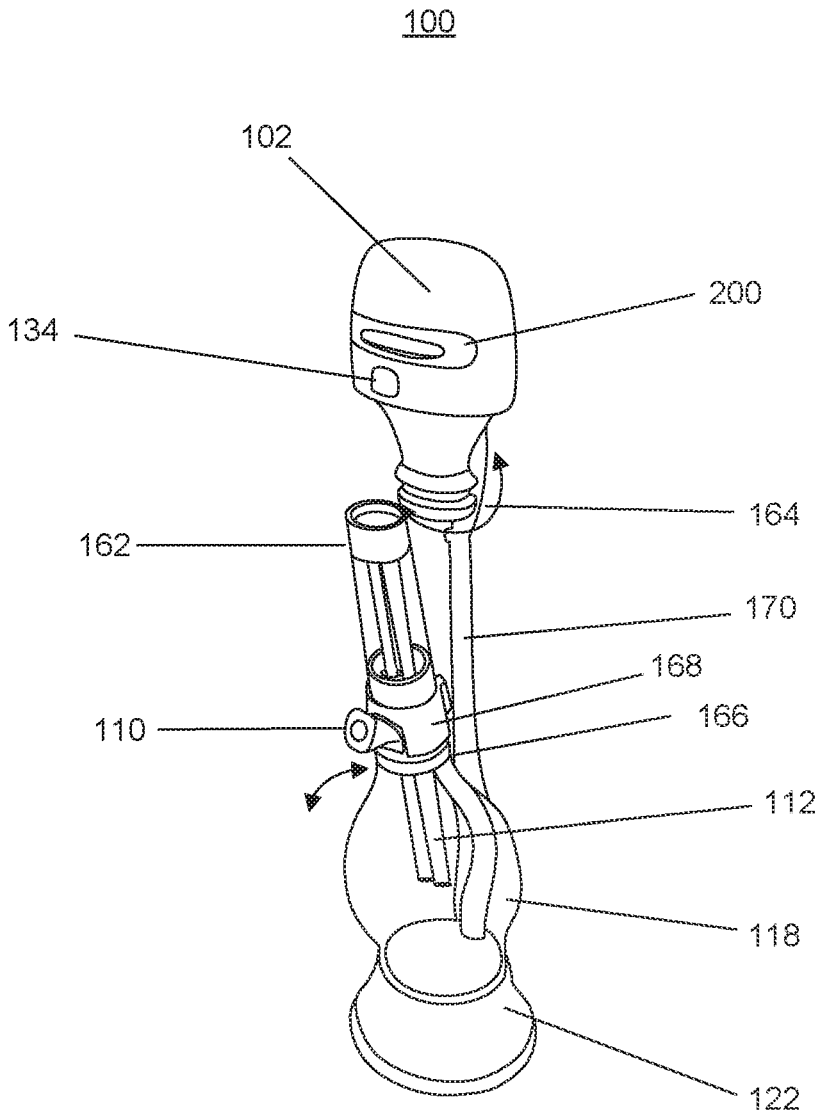
FIG. 1B is a diagrammatic illustration of an alternative exemplary hookah, according to an embodiment of the disclosure.

FIG. 1B is a diagrammatic illustration of an alternative exemplary hookah, according to an embodiment of the disclosure. FIG. 1B presents hookah 100 including cover 102, heating apparatus 200, stems 112, connector 110, charging dock 122, and LED 134. FIG. 1B also presents an upper hermetic seal 162, release ring 164, middle hermetic seal 166, middle release ring 168, and connecting column 170.

Upper hermetic seal 162 and middle hermetic seal 166 may be attached to reservoir 118. In some embodiments, Upper hermetic seal 162 and middle hermetic seal 166 may include sealing materials such as rubbers and epoxies. In other embodiments, upper hermetic seal 162 and middle hermetic seal 166 may also include glass-to-metal hermetic seals, such as matched seals or compression seals, and/or ceramic-to-metal hermetic seals. In yet other embodiments, upper hermetic seal 162 and middle hermetic seal 166 may include PTFE sealing rings, o-rings, PTFE sleeves, and/or lubricants that create an airtight seal between the hermetic seal 162 and release ring 164.

Release ring 164 and middle release ring 168 may have a secure position and a release position. In the secure position, the rings may fix the position of stems 112 and reservoir 118. Rings may also connect with hermetic seals creating an air-tight and water proof seal forcing any air transfer through stems 112. Release ring 164 and middle release ring 168 may also be configured to prevent water leaks. In some embodiments release ring 164 may get screwed with hermetic seal 162 in the secure position. However, in other embodiments the release rings may use other methods for attaching to hermetic seals. For example, the release ring may use a pressure lock mechanism or compression fittings to attach. The release rings may be made of metals, plastics, epoxies or any combination. The release ring may also include gaskets, such as o-rings, to seal reservoir 118.

In some embodiments, hookah 100 may include connecting column 170, which may join cover 102 and charging docket 122. Connecting column 170 may conform to the shape of reservoir 118. Connecting column 170 column may be rigid and may be on the outside of the reservoir 118. Connecting column 170 may be hollow to minimize weight. In other embodiments, connecting column 170 may be flexible.

Connecting column 170 may facilitate preparation of hookah 100 for a smoking session by supporting components during preparatory steps. For example, connecting column 170 may support all elements of hookah's 100 top section when reservoir 118 is removed. Thus, cover 102, heating apparatus 200, holder 128, carbon monoxide detector 132, and LED indicator 134 may be held up by connecting column 170 when reservoir 118 is removed from hookah 100 for refilling or cleaning. Connecting column may be rigid but include flexible elements to ease reservoir 118 release. In some embodiments connecting column 170 may include springs or linear slides to create room between hookah components during reservoir 118 removal. In other embodiments, connecting column 170 may include hinges that divide the column in a plurality of portions, opening or closing hookah 100 to release or secure reservoir 118. In yet other embodiments, connecting column 170 may be attached to charging docket 122 with a multi-position locking hinge. In such embodiment, a first position may configure hookah 100 for a smocking session while a second position may be use for filling or cleaning the reservoir. The difference between the first and the second position may be an angle between 20° and 70°. In such embodiments, a user may tilt the reservoir for filling or cleaning without fully disassembling hookah 100. For example, reservoir 118 may be tilted 45° to the front to replenish water while connecting column 170 supports the top components of hookah 100. Alternatively, reservoir 118 may be fixed but connecting column 170 may be tilted for filling and cleaning steps.

Figure 2A:
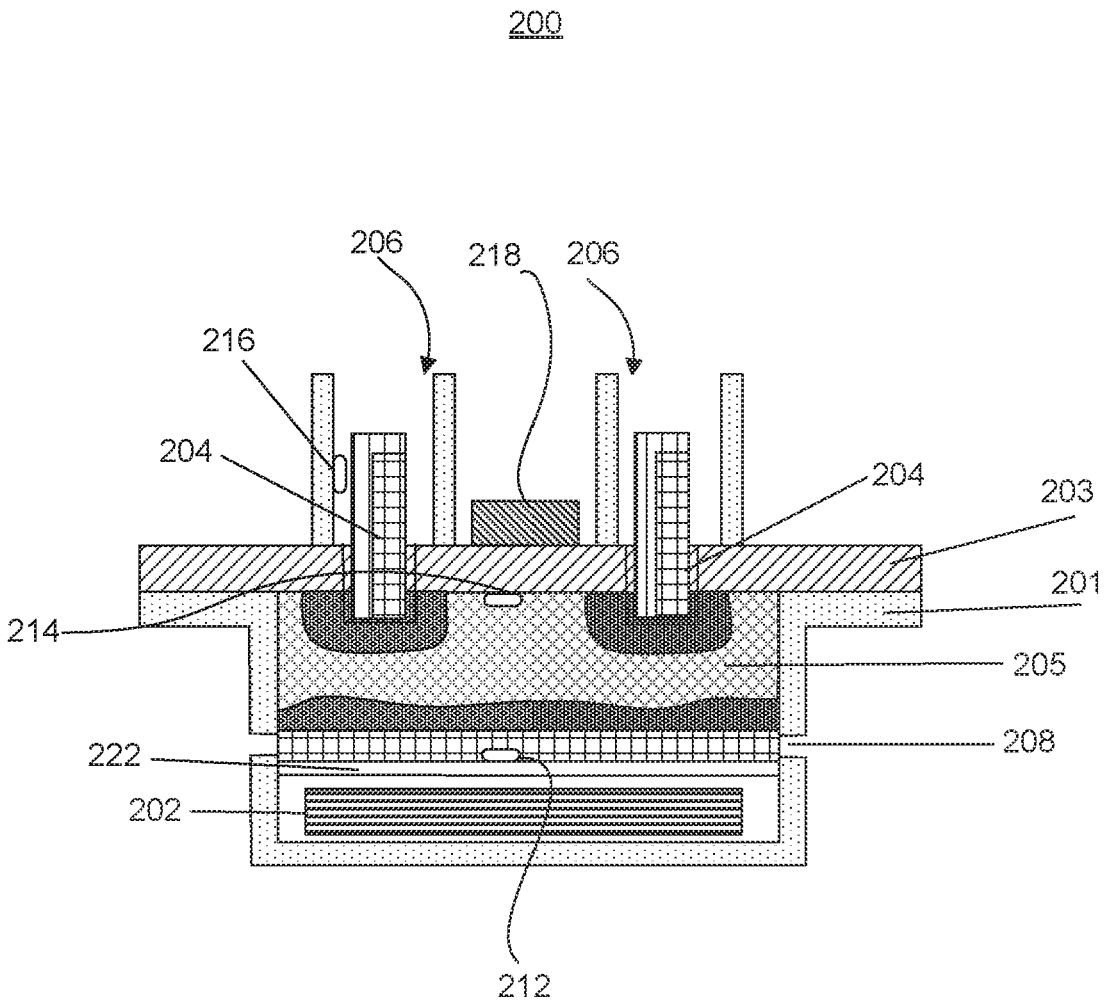
FIG. 2A is a diagrammatic illustration of an exemplary heating apparatus, according to a disclosed embodiment.

FIG. 2A is a diagrammatic illustration of an exemplary heating apparatus, according to a disclosed embodiment. Heating apparatus 200 may be on the top portion of hookah 100 and may include a bottom piece 201 and a top piece 203. When assembled, bottom piece 201 and top piece 203 form chamber 205, which has a cavity to house the material or substance to be heated. In some embodiments, bottom piece 201 a top piece 203 may create a hermetic seal when they are assembled. For example, top and bottom pieces may include rubbers between the two pieces to prevent air leaks. In addition, bottom and top pieces may have securing mechanisms, such as hooks, to prevent separation of the two pieces during operation. The bottom chamber may also include a bottom heater 202, air outlets 208, a bottom sensor 212, and a mesh 222.

In some embodiments, bottom heater 202 may be set in the bottom surface of chamber 205, as presented in FIG. 2A. Alternatively or additionally, bottom heater 202 may be on the exterior of the chamber 205, attached to the bottom and/or the sides of bottom piece 201. In other embodiments bottom heater 202 may cover or be attached to the sides of bottom piece 201. In such embodiments, bottom heater 202 may be attached to a portion of the chamber walls. For example, bottom heater 202 may be covering the lower 10-50% of the chamber wall but can also cover the full wall.

Bottom heater 202 may be an inductive heater and have a coiled conductor. The coiled conductor may be a conductive wire, such a copper reel, wrapped around a core. The core may be a solid of some dielectric material, such as a ceramic or plastic, but may also be a ferromagnetic material (e.g. an iron core). Alternatively, the core may be bottom piece 201, chamber 205, a capsule 300 or other components of heating apparatus 200. Also, in these embodiments bottom heater 202 may be connected to a power circuit, powered by battery system 120, capable of producing an alternating current to generate inductive heat. The power circuit for bottom heater 202 may be an oscillator generating a tension with a frequency between 5-500 kHz and a power between 50-500 W. The power circuit may be connected to a controller such as a microprocessor that controls amplitude and/or frequency. This controller is further described in FIG. 6.

Additional embodiments may have a plurality of heater types as bottom heater 202. For example, bottom heater 202 may be set as a Peltier heater connected to a direct current power circuit. Also, bottom heater 202 may be a heating blower that heats the chamber using forced convection. Additionally, bottom heater 202 may use radiation sources, such as halogen lamps or may use conductive heaters such as heating cartridges and/or resistive heaters. Alternatively, bottom heater 202 may use microwave heaters that generate electric fields in radio frequencies and heat chamber 205 with dielectric heating. While FIG. 2A presents a single bottom heater 202, other embodiments may include a plurality of bottom heaters 202 of a single or multiple types, for example an inductive heater may surround chamber 205 while a contact heater may be attached to bottom piece 201.

Air outlets 208 may be positioned in a plurality of locations of bottom piece 201. For example, as presented in FIG. 2A, air outlets 208 could be on the sides of bottom piece 201, parallel to the bottom surface. Alternative embodiments, may have air outlets 208 in the bottom surface of the chamber. A single or a plurality of air outlets 208 may be in the chamber. However, in other embodiments, bottom piece 201 may have no air outlets and rely on the porosity of the chamber or other air pathways to evacuate vapors and/or smoke generated during the heating process. In some embodiments, air outlets 208 are connected to other elements of hookah 100. For example, air outlet may be connected to stems 112 to direct vaporize smoke or vaporized material to reservoir 118. In addition, air outlets 208 may include filters such as activated carbon in the interface between heating apparatus 200 and stems 112.

Mesh 222 may be inside the chamber 205. Mesh 222 may have a shape that mimics the shape of chamber 205 and it may be a fiber fleece or other porous material. Additionally, mesh 222 may be formed with a single material like a conductive metal. Alternatively, mesh 222 may be formed with a ceramic or a ferrous material. In other embodiments mesh 222 may be formed with multiple materials. For example, mesh 222 may have a ceramic core covered with metals or other conductors. Further, mesh 222 may be positioned between the first heater and the substance inside the chamber or may be attached to bottom heaters 202.

Bottom sensor 212 may be in proximity to bottom heater 202. Elements are in proximity when the distance between them is below a threshold or they share a common region. For example, bottom sensor 212 and bottom heater 202 may be in proximity when they are within 5 mm of each other. Alternatively, sensors and heaters may be in proximity when they are in an isothermal region. Furthermore, elements may be in proximity if they are in physical contact and/or attached to each other.

In some embodiments bottom sensor 212 may be a single or a group of thermocouples which may be of types J, K, E, and/or T. In other embodiments, bottom sensor 212 may be a bi-metallic thermostat, a thermistor, or a resistive temperature detector. In addition, bottom sensor 212 may include electronics for voltage readings and signal filtering. For example, bottom sensor 212 may have embedded operational amplifiers and resistors configured to amplify the signal and minimize noise. Additionally, bottom sensor 212 may have a plurality of sensing elements working independently or as a group.

Heating apparatus 200 has a top piece 203, which may include top heaters 204, air inlets 206, top sensor 214, and tag reader 218. Top heaters 204 may be elements similar to the ones described for bottom heater 202, in contact or fixed to top piece 203. Top heaters 204 may be a plurality of independent heaters, as shown in FIG. 2A, with autonomous power circuits. Other embodiments may have a single top heater 204 powered by a unique circuit. Yet other embodiments may involve multiple top heaters but powered with a single circuit that, for example, provides current to each heater in a parallel. Similar to bottom heater 202, the power delivered to top heaters 204 may be determined by a controller or processor setting power, frequency, or amplitude of the power circuit output.

Top piece 203 may also include air inlets 206 that traverse the top piece into chamber 205. Air inlets may have a diameter of, for example 1-50 mm. In certain embodiments, the position of top heaters 204 may be dictated by air inlets 206. For example, as presented in FIG. 2A, top heaters may be inside the air inlets. However, other embodiments may simply attach heaters to the inside of top piece 203. Yet other embodiments may position top heaters 204 on top of top piece 203 and deliver heat through top piece 203.

Top heaters 204 may have a large surface and cover most of the air inlets 206 cross section. Top heaters 204 with a large surface may facilitate heat transfer between top heaters 204 and air being flown into the chamber. In some embodiments, top heaters 204 may be elongated in the same direction of air flow. In other embodiments, top heaters 204 may be porous with a large surface to volume ratio. In such embodiments top heaters 204 may be shaped as a sieve and have holes to let the air flow through to maximize exposure and facilitate heat transfer. In yet other embodiments, top heaters may be flexible and conform to the shape of tubes and air guides going into chamber 205.

Top sensor 214 may replicate bottom sensor 212 but may be positioned in proximity to top piece 203. For example, top sensor 214 may be inside the chamber crossing top piece 203. Additionally, in some embodiments top sensor 214 can be embedded in top heater 204. Hence, when there is a plurality of top heaters 204, there may also be a plurality of top sensors.

Consistent with embodiments of this disclosure, air inlet sensor 216 may be included in heating apparatus 200. Air inlet sensor 216 may be placed within the air inlet 203 and may be in proximity with one of top heaters 204. Air inlet sensor 216 may be parallel to the air flow but may also be perpendicular to the air flow. In addition, air inlet sensors 216 may substitute top sensor 214 or may be electrically coupled to top sensor 214.

It is contemplated that top piece 203 may include tag reader 218. Tag reader 218 may be attached to top piece 203, in the exterior or in the interior of chamber 205. Tag reader 218 may be an RFID reader configured to interact with an RFID tag located for example in a capsule, or another type of scanner configured to read another type of identifier. For example, tag reader 218 may be a camera configured to read a barcode or a quick response code. Based on the reading of the tag reader 218, heating apparatus 200 may select different operation parameters. For example, based on the identification performed by tag reader 128, heating apparatus 200 may select a specified basic temperature of bottom heater 202 a top heater 204. In addition, heating apparatus 200 may be enabled only when tag reader 218 identifies there is a capsule and/or that the capsule is identifiable. Further, tag reader 218 may transmit information of the contents of chamber 205. It is also contemplated that a tag reader 218 is embedded in a different element of heating apparatus 200. For example, tag reader 218 and top sensor 214 may be in a single element with parallel functions.

Figure 2B:
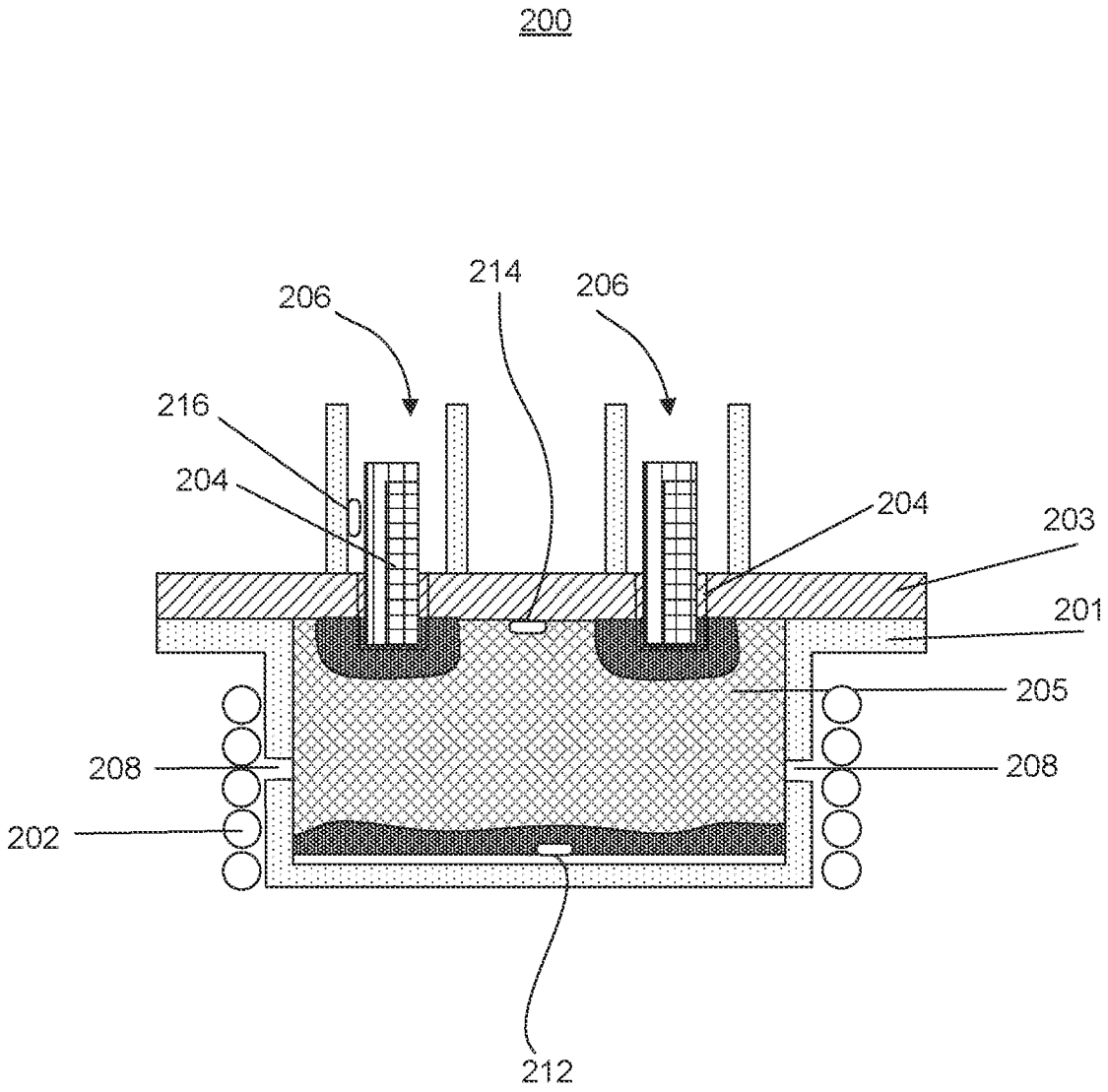
FIG. 2B is a diagrammatic illustration of an exemplary heating apparatus, according to a disclosed embodiment.

FIG. 2B is a diagrammatic illustration of an exemplary heating apparatus, according to a disclosed embodiment. Heating apparatus 200 in FIG. 2B replicates elements described in FIG. 2A but has no mesh 222 and has bottom heater 202 on the outside of the chamber 205, surrounding the walls of bottom piece 201. In such embodiments, bottom piece 201 may be fabricated with a metal such as aluminum, copper, or iron. However, in other embodiments bottom piece 201 may be composed of other conductive materials such as graphite, conductive polymers, or metalloids. In addition, bottom piece 201 may be a non-conductive material, such as a ceramic, coated by a conductive material. FIG. 2B shows bottom heater 202 as a coiled conductor wrapped around chamber 205. However, in some embodiments bottom heater 202 may be a plurality of contact heaters powered with independent control circuits or connected to a single controller and circuit. In this embodiment, bottom heater 202 may also be any of the heater types previously disclosed.

Figure 2C:
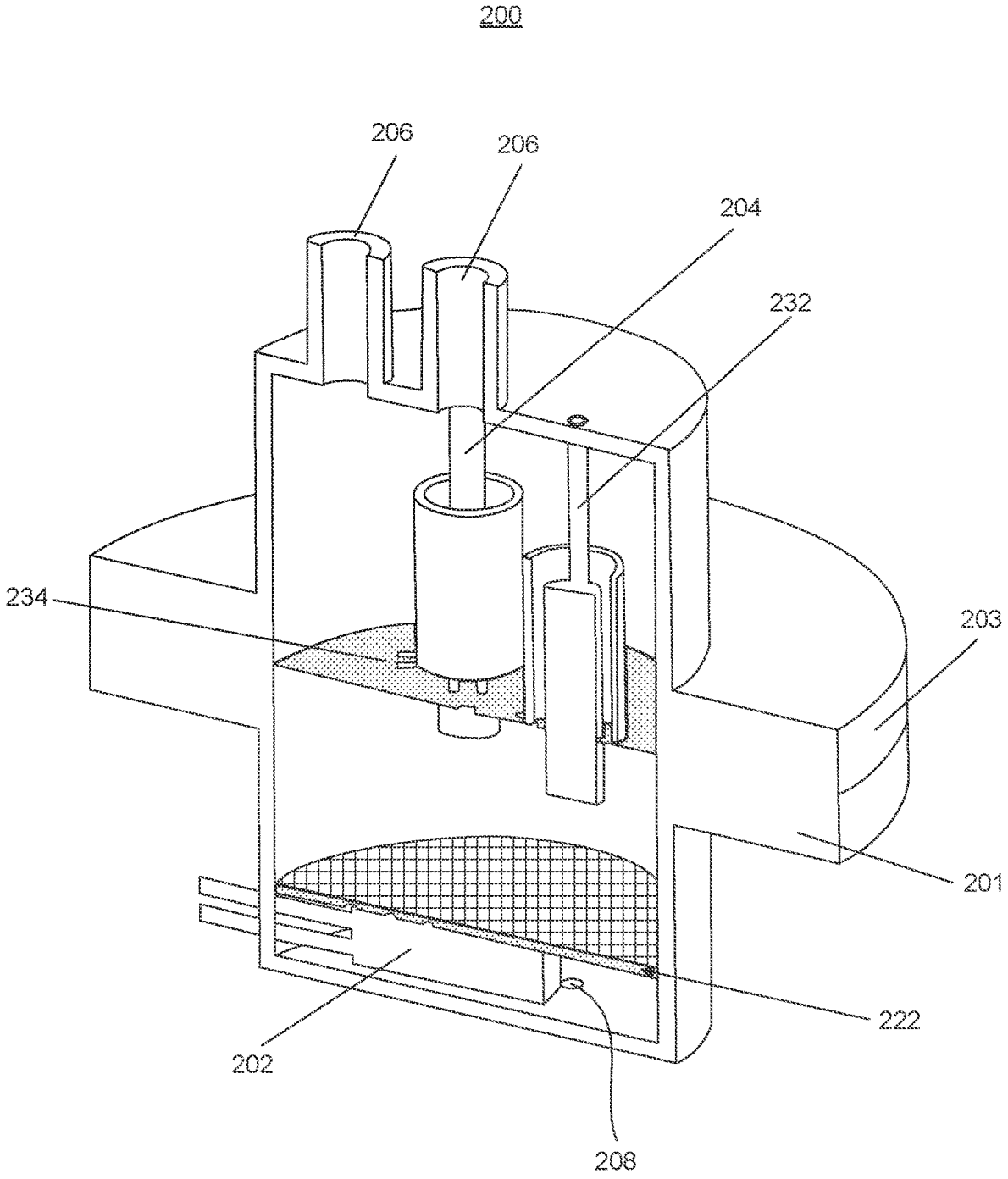
FIG. 2C is a perspective view of an exemplary heating apparatus, consistent with a disclosed embodiment.

FIG. 2C is a perspective view of an exemplary heating apparatus, consistent with a disclosed embodiment. Heating apparatus 200 in FIG. 2C also replicates elements of FIG. 2A but shows a different arrangement of air inlets 206 and air outlets 208. The exemplary heating apparatus 200 of FIG. 2C also presents a holding heater 232, and a top plate 234.

Air inlets 206 may be in different positions of top piece 203. As shown in FIG. 2C, air inlets 206 may be in the center of top piece 203 or the periphery of top piece 203, and could also be extending from the sides of top piece 203. Additionally, in certain embodiments heating apparatus 200 may have air inlets 206 with and without enclosed heaters. Further, air outlets 208 may be in the bottom of the bottom piece 201 and have a narrower diameter than the air inlets to promote air circulation inside chamber 205 and trigger the vaporization reaction.

Top plate 234 may be a thermally conductive plate positioned between top heaters 204 and chamber 205. It may also be placed between top piece 203 and bottom piece 201, and may be supported by the edges of top and bottom pieces. Additionally, top plate 234 may be in other locations of chamber 205 attached to one or more of the elements of heating apparatus 200. For example, top plate 234 may have coated portions with silicones or rubbers that attach it to heating apparatus 200.

In some embodiments, top plate 234 may be a metallic plate, made of aluminum or copper. In addition, top plate 234 may be thin in order to promote heat transfer from top heaters 204 into the chamber. For example, top plate 234 may have a thickness of less than 0.5 mm. In other embodiments, top plate 234 may be a membrane or a plastic with adequate thermal properties to enable heat transport. Furthermore, if top heater 204 is inductive, the top plate may be have the magnetic properties to induce heat based on the variable magnetic fields.

Consistent with embodiments of this disclosure, FIG. 2C also presents holding heater 232. In some embodiments, holding heater may be a heater attached to top plate 234. Holding heater 232 may be independent from top heater 204 or may be thermally and/or electrically coupled to top heater 204. Additionally, in some embodiments holding heater 232 may mirror temperature of bottom heater 202. In such embodiments, holding heater 232 may be configured to be operated during an initial warm up and may prevent heat losses during the heating process.

Figure 2D:
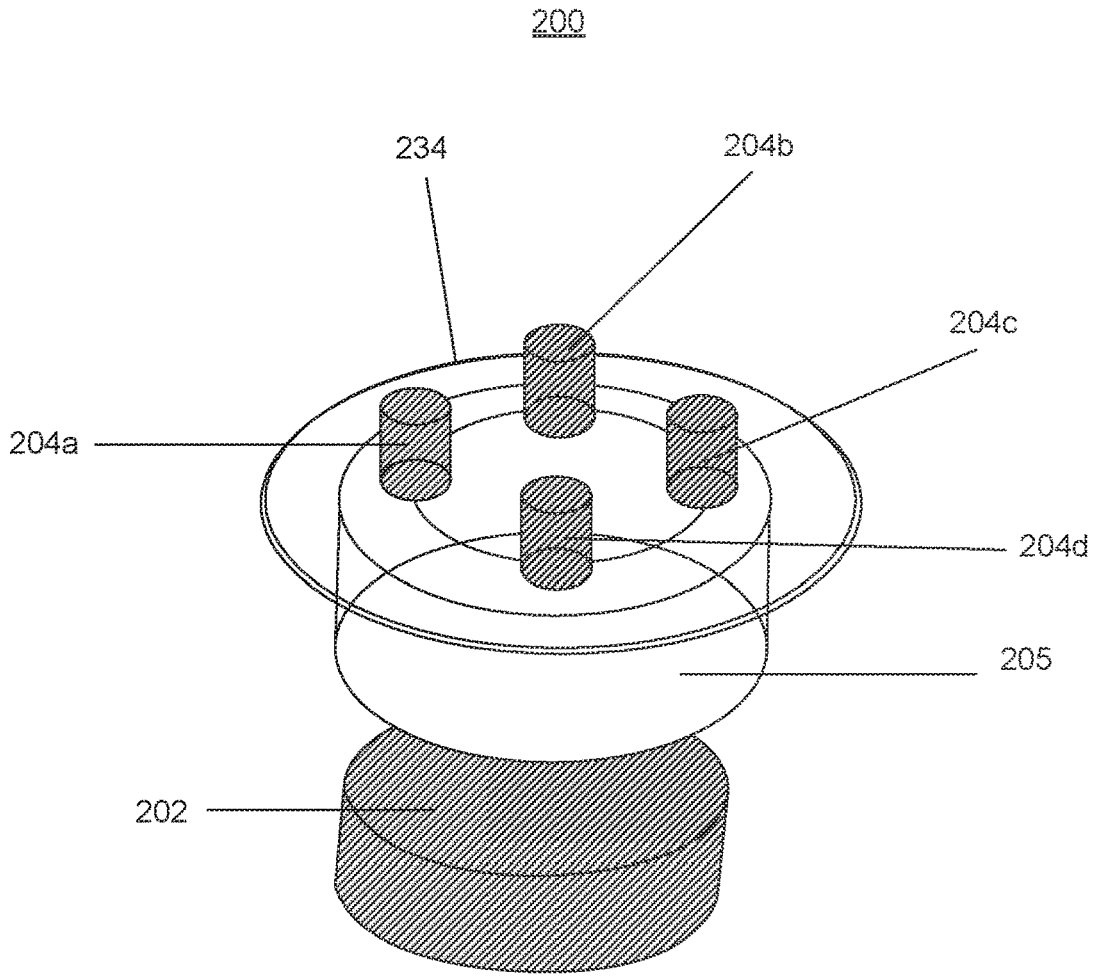
FIG. 2D is a perspective view of an exemplary heater arrangement, according with a disclosed embodiment.

FIG. 2D is a perspective view of an exemplary heater arrangement, according with a disclosed embodiment. As discussed, heating apparatus 200 may include one or more top heaters. FIG. 2D presents an embodiment where top heaters are divided in four elements arranged on top plate 234. Additionally, FIG. 2D presents bottom heater 202 and a simplified view of chamber 205. In this embodiment, top heaters 204*a*-204*d* may be independently controlled and can be powered in a determined sequence. The sequence can be established by a time period during operation. For example, each one of top heaters 204*a*-204*d* may be individually powered for one second. In this way, the hottest area in chamber 205 will be periodically changed preventing issues like overheating and/or uneven burning. In other aspects of this disclosure, the powering sequence of the top heaters may be based on temperature sensors, such as inlet sensor 216. For example, a sudden spike in the measured temperature may indicate that air is being flown into the chamber. Then, heating apparatus 200 may identify that a cycle has ended and respond by switching the power to a new top heater from 204*a*-204*d*. While some embodiments may have a single heater being powered in every cycle, other embodiments may have two or more heaters powered at the same time. Further embodiments may allow a user to manually switch the duration and time at which any of the top heaters are powered. For example, a user may elect to have only heater 204*a* powered on during a single session, or alternatively, to have heater 204*a* powered on for an elongated time period (e.g., one hour) before manually switching the power to heater 204*b*.

Additionally, each one of top heaters 204*a*-204*d* may be set at specific power capacities. Thus, some of the heaters may be set at a full power capacity while other heaters may be set at a partial power capacity. For example, top heater 204*a* may be set at a half power capacity while the other heaters are at a full power capacity to control combustion. Moreover, the selected power capacity may be constant throughout a session or it may be dynamic. The power may be set manually by the user or may be automatically determined by a controller.

Figure 2E:
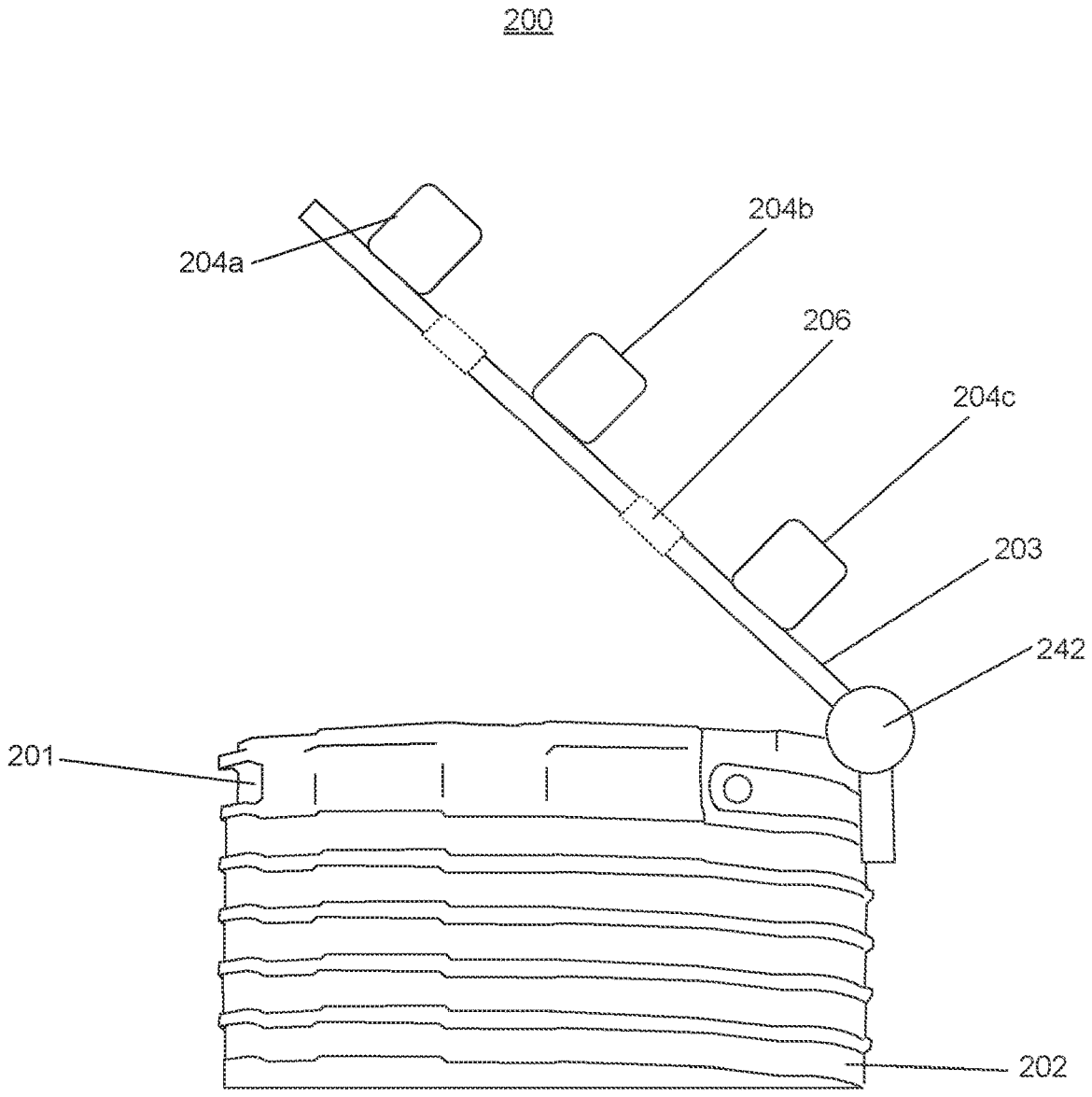
FIG. 2E is a diagrammatic illustration of an exemplary heating apparatus, according with a disclosed embodiment.

FIG. 2E is a diagrammatic illustration of an exemplary heating apparatus, according with a disclosed embodiment. Heating apparatus 200 in FIG. 2E replicates some of the elements previously presented, including bottom heater 202 coiled around bottom piece 201, top heaters 204, top piece 203, and air inlets 206. However, embodiment of FIG. 2E also presents hinge 242 which attaches top piece 203 and bottom piece 201. In some embodiments, hinge 242 may include a movable joint which gates, slides, or swings top piece 203 to open and close bottom piece 201. FIG. 2E presents a single hinge joining top piece 203 and bottom piece 201 but alternative embodiments may include a plurality of hinges and top piece 203 divided into a plurality of panels. In other embodiments, hinge 242 may connect two portions of bottom piece 201 while top piece 203 is fixed to a portion of bottom piece 201. Then, portions of bottom piece 201 may gate, slide, or swing opening and closing chamber 205. For example, one of the lateral surfaces of bottom piece 201 may be connected with hinge 242 creating a door opening that would open or close chamber 205. Hinge 242 may be made of plastics, metals, or glass, or any other suitable material that mechanically supports movement of top and bottom pieces. Additionally, embodiments in which top piece 203 is attached to the bottom piece 201 with a sliding mechanism may include rollers, tracks, and slide guides.

Figure 2F:
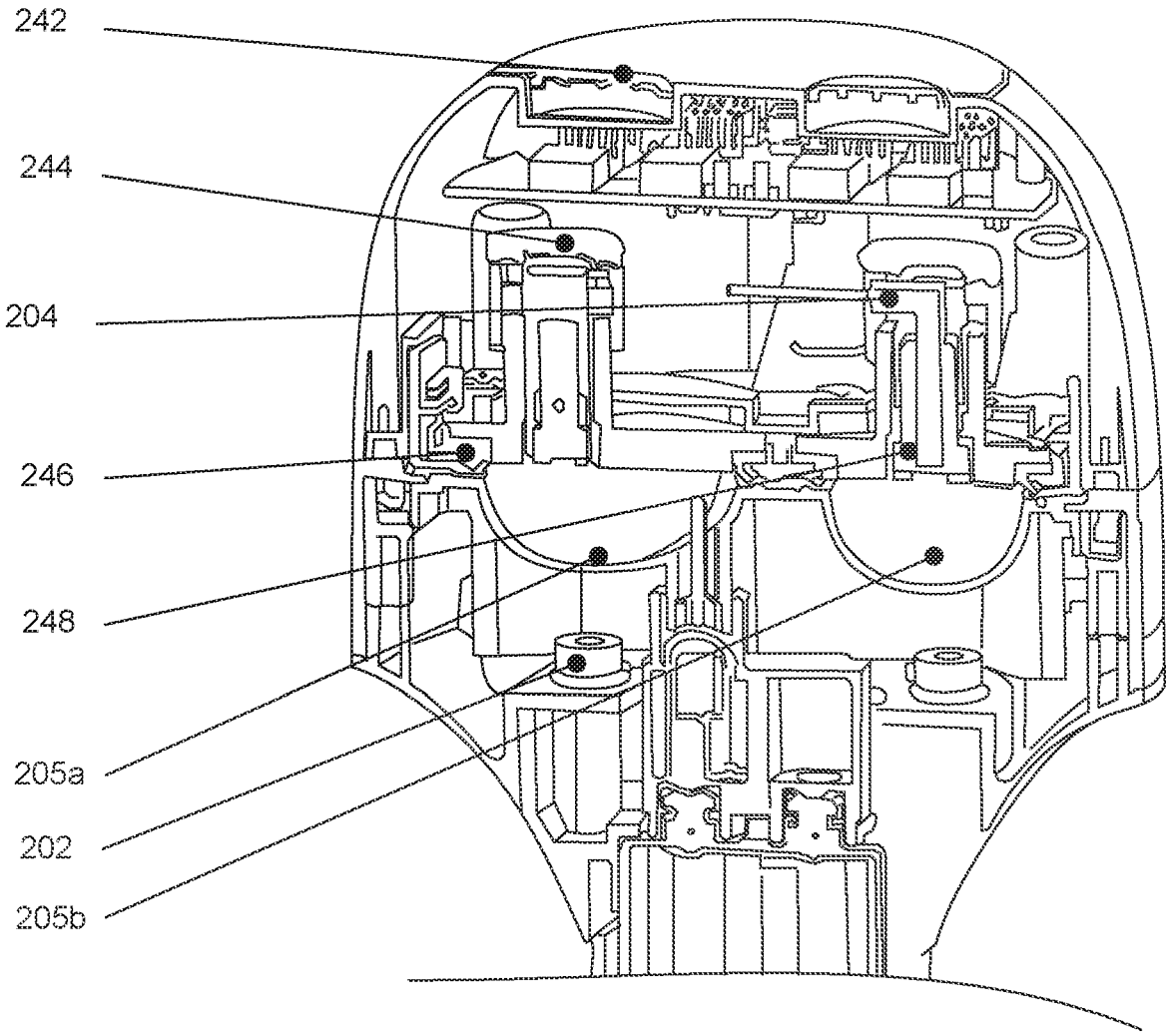
FIG. 2F is a diagrammatic illustration of an exemplary heating apparatus with two chambers, according to a disclosed embodiment.

FIG. 2F is a diagrammatic illustration of an exemplary heating apparatus with two chambers, according to a disclosed embodiment. FIG. 2F presents an embodiment of heater 200 with two independent chambers (205*a* and 205*b*). Each chamber includes top heater 204 and bottom heater 202. FIG. 2F presents a symmetric heating apparatus in which all elements are duplicated to operate the two chambers. FIG. 2F also presents a button capsule piercing 242, a piercing unit 244, a chamber sealing 246 and a heat exchanger 248.

Button capsule piercing 242 may be a retractable button in cover 102 that mechanically forces piercing unit 244 into a capsule. Button capsule piercing 242 may include a spring or an elastic component to return to an original position after the pressure is applied. In some embodiments, button capsule piercing 242 may have a similar shape to capsule 300.

Pressure applied to the button capsule piercing 242 may be transmitted to piercing unit 244. Piercing unit 244 may include motors and springs that may be actuated by a controller or driver. Then, piercing unit 244 may be activated when button capsule piercing 242 is pressed. Alternatively, piercing unit 244 may be a puncturing element, such a sharp solid that moves forward when button capsule piercing 242 is pressed.

Chamber sealing 246 may be configured to prevent smoke leaks between top piece 203 and bottom piece 201, in each one of the chambers of heating apparatus 200. Chamber sealing 246 may include materials such as rubbers and epoxies. In other embodiments, chamber sealing 246 may also include glass-to-metal hermetic seals, such as matched seals or compression seals, and/or ceramic-to-metal hermetic seals. In yet other embodiments, chamber sealing 246 may include PTFE sealing rings, o-rings, PTFE sleeves, and/or lubricants that create an airtight seal between top piece 203 and bottom piece 201.

In some embodiments, heater apparatus 200 may include heat exchanger 248. A heat exchanger 248 may be used to transfer heat generated. Heat exchanger 248 may include, for example, a shell and tube, plate, plate and shell, or plate and fin heat exchanger. In some embodiments, heat exchanger may include an adiabatic wheels exchanger, a phase-change exchanger, a pillow plate exchanger, or a direct contact exchanger include solid, liquid, or gaseous mediums. Heat exchanger 248 may be adjacent to top heater 202 and/or bottom heater 204, allowing the heat generated to travel to heat exchanger by means of conduction. An alternative arrangement may include having a coolant fluid flow through top heater 202 and carry the excess heat to heat exchanger 248 where it can be expelled.

Figure 3:
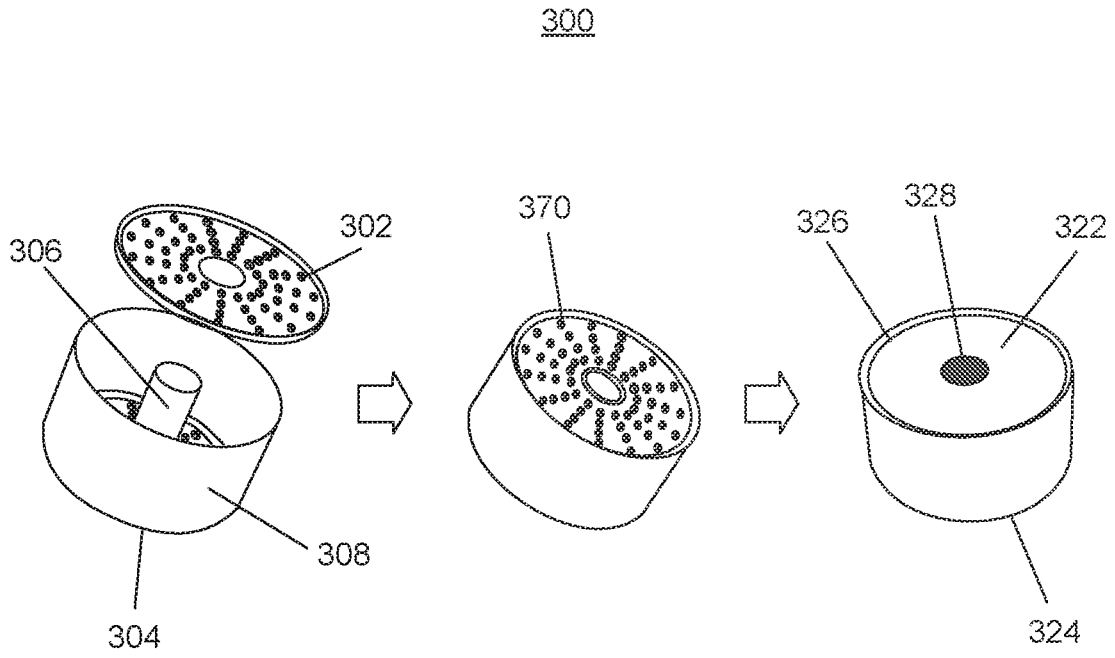
FIG. 3 is a perspective view of an exemplary capsule, according to the disclosed embodiments.

FIG. 3 is a perspective view of an exemplary capsule, according to the disclosed embodiments. Capsule 300 may include a body with an inner surface 306 and an outer surface 308. The thickness of inner surface 306 and outer surface 308 may range between 20 um and 120 um. In some embodiments, inner surface 306 and outer surface 308 may be cylinders made of, for example, a metal. In such embodiments inner surface 306 and outer surface 308 may be concentric (as presented in FIG. 3) but other arrangements are also contemplated. In other embodiments inner and outer surfaces may have other shapes and may include different modules. For example, inner and outer surfaces may be shaped as a leaf or may conform to chamber 205, which itself may be shaped like a leaf to facilitate insertion. In yet other embodiments, outer surfaces may have toroidal or arched shapes. They may also have one or multiple indentations to create the cavities.

Capsule 300 may also include a cap 302 and a base 304. Cap 302 and base 304 may match the geometry of inner and outer surfaces. In addition, cap 302 and base 304 may be symmetric. In some embodiments, cap 302 and base 304 may include air holes 370, which may be stamped and/or drilled to promote even airflow through the cavity formed in the capsule. In some embodiments, capsules may be formed with complementary tops and bottoms so they may be stackable on one another. In yet other embodiments, capsule 300 may include a mesh enclosed by cap 302 and base 304 (not shown). The mesh may mimic the shape of the inner and outer surfaces and complement indentations so it is secured to the surfaces.

As it is shown in FIG. 3, in some embodiments inner surface 306, outer surface 308, cap 302, and base 304 may get assembled to form capsule 300. In such embodiments, each piece may have a connector to other pieces. For example, each piece may have threads to secure pieces with each other, or may have pressure fittings securing the pieces. In other embodiments, inner surface 306, outer surface 308, cap 302, and base 304 may get assembled with a heat sealing process. In such embodiments, a melt adhesive may be included in capsule 300 to aid in the assembly process. When assembled, capsule 300 forms a cavity between the four elements. The cavity may be filled with smokable material, such as tobacco, shisha, mu'assel, herbs, sweeteners or other organic elements that can be vaporized (see table 1). The smokable material may also include liquids, such as oils and extracts. For example, the cavity of capsule 300 may be filled with concentrates such as the ones used in electronic cigarettes. In addition, capsule 300 may include combinations of smokable materials with matching or complementary flavors. In other embodiments, the cavity in capsule 300 may be hold medicinal, aromatic, or botanical material. For example, capsule 300 may have albuterol, salmeterol or other medications used in nebulizers. Capsule 300 may also contain solid, un-smokable materials such as pebbles that are coated with liquids or oils. In yet other embodiments, the cavity of capsule 300 may contain a plurality of substances. For example, tobacco may be combined with oils or medicinal substances.

Capsule 300 may also include cap seal 322 and base seal 324. Cap seal 322 and base seal 324 may be adhesives or stickers that cover air holes 370. In some embodiments, seals may be have a sticky side which secures the seal against the cap 302 or base 304. In additional or alternative embodiments, seals may be made of an impermeable but puncturable material, such as plastics, light metals, or other membranes. A puncturable material is any material having mechanical properties that allow it to be punctured by for example, a needle or a tin-tack. Additionally, cap seal 322 may include a pull tab 326 which may allow a user to remove the seal. In other embodiments, cap seal 322 and cap 302 may be a single element with a plurality of properties. Similarly, base seal 324 and base 304 may also be a single element.

Capsule 300 may include one or multiple protective coatings covering the inner surface 306, outer surface 308, cap 302, and/or base 304. The protective coatings may also be disposed in the junctions of different elements of capsule 300. For example, protective coatings may cover the edges of cap 302 that are in contact with outer surface 308. The protective coatings may include resins, acrylic layers, and nitrocellulose layers or any combination. In addition, the protective coatings may be selected to stand high temperatures or create a heat-seal. For example, the protective coating may include high temperature ceramic and graphite adhesives. The protective coatings may cover inner and outer portions of capsule 300 and have different functions. For example, in some embodiments a heat-seal protective coating may cover the inside of capsule 300 cavity to prevent heat losses, while an exterior anti-scratch protective coating may be used to prevent mechanical wear and punctures. In addition, protective coatings used in capsule 300 may be selected to safeguard the contents of capsule 300. For example, exterior protective coatings may be used as a waterproof layer and antimicrobial protective coatings may be used in the inside of the cavity to prevent degradation.

It is also contemplated that capsule 300 includes identity tag 328. Identity tag 328 may comprise any suitable identification element, such as hardware or barcodes, configured to provide information associated with capsule 300. The identity tag 328 may be configured to communicate with tag reader 218 and/or other associated systems. In certain embodiments, the identity tag 328 may comprise a Near Field Communication ("NFC") tag, a radio-frequency identification ("RFID") tag, a universal serial bus ("USB") token, a Bluetooth®-enabled ("BLE") device storing secure information, and/or the like. In further embodiments, the identity tag 328 may be implemented via hardware included in an associated device. It will be appreciated that a variety of other types of tags may be used in connection with the identity tag 328 and/or presence verification processes disclosed herein, and that any type of tag or bar code may be used in connection with the disclosed embodiments.

In certain embodiments, the identity tag 328 may be provisioned with information of the contents in capsule 300. The information may comprise any suitable information and/or value that may be used in connection with the embodiments disclosed herein. In certain embodiments, the information may include temperatures of operation, type of material, and/or expiration date. This information may be readable by the controller and be used to customize, for example, the temperature of heaters, power delivered to the heaters, or operation cycles. In other embodiments, the tag need not provide information of the capsule contents, but may, for example, store information of the capsule manufacturer.

Figure 4:
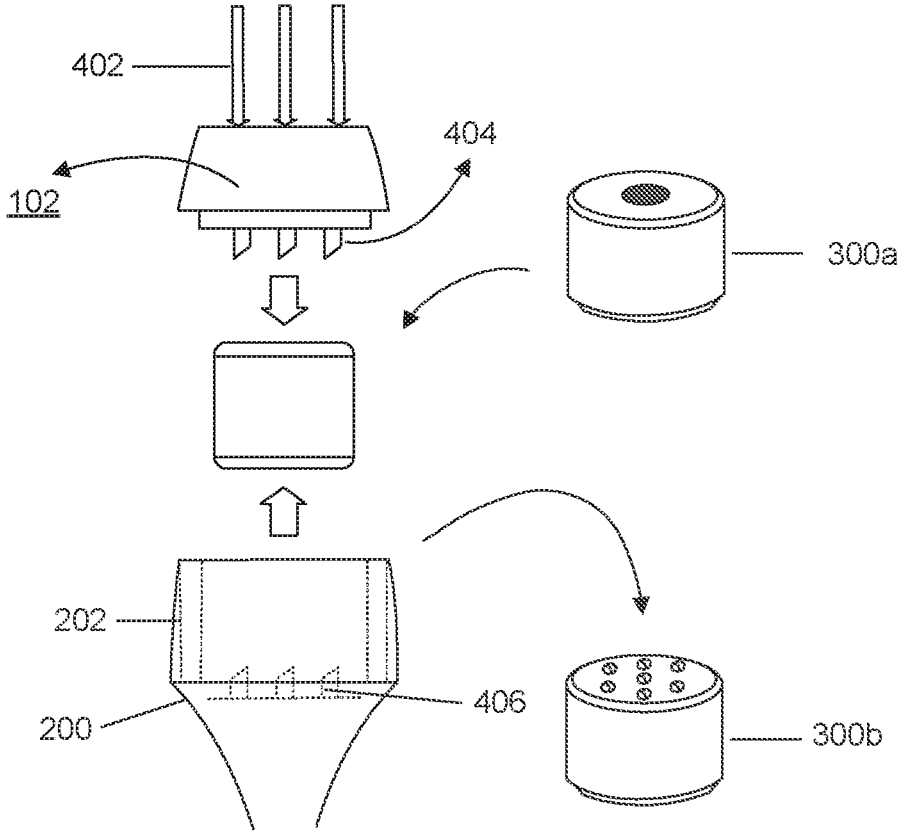
FIG. 4 is a diagrammatic illustration of an exemplary embodiment of a cover, heater, and a capsule, according to a disclosed embodiment.

FIG. 4 is a diagrammatic illustration of an exemplary embodiment of a cover, a heater, and a capsule, according to a disclosed embodiment. FIG. 4 presents heating apparatus 200 interaction with other elements such as the cover 102 and capsule 300.

In some embodiments, cover 102 may include cover holes 402 to facilitate air exchange with heating apparatus 200. Additionally, cover 102 may have a piercing device 404 which may be located in the bottom of cover 102, facing heating apparatus 200. Piercing device 404 may be electronic and include motors and springs that may be actuated by a controller or driver. Then, piercing device 404 may be activated when materials are placed in heating apparatus 200, such that piercing device 404 operates in conjunction with controllers and sensors of hookah 100.

FIG. 4 also shows capsule 300 in different stages of a session. New capsule 300*a* may be placed inside chamber 205 of heating apparatus 200. Cap seal 322 and base seal 324 may then be punctured by piercing device 404 when the cover is placed on top of the heater. In some embodiments, the bottom of chamber 205 may also have a lower piercing device 406. When the capsule is placed in chamber 205 and heating apparatus 200 is assembled, bottom heater 202 may trigger the vaporization process. At the end of the process, used capsule 300*b* may be retrieved from the chamber.

Figure 5A:
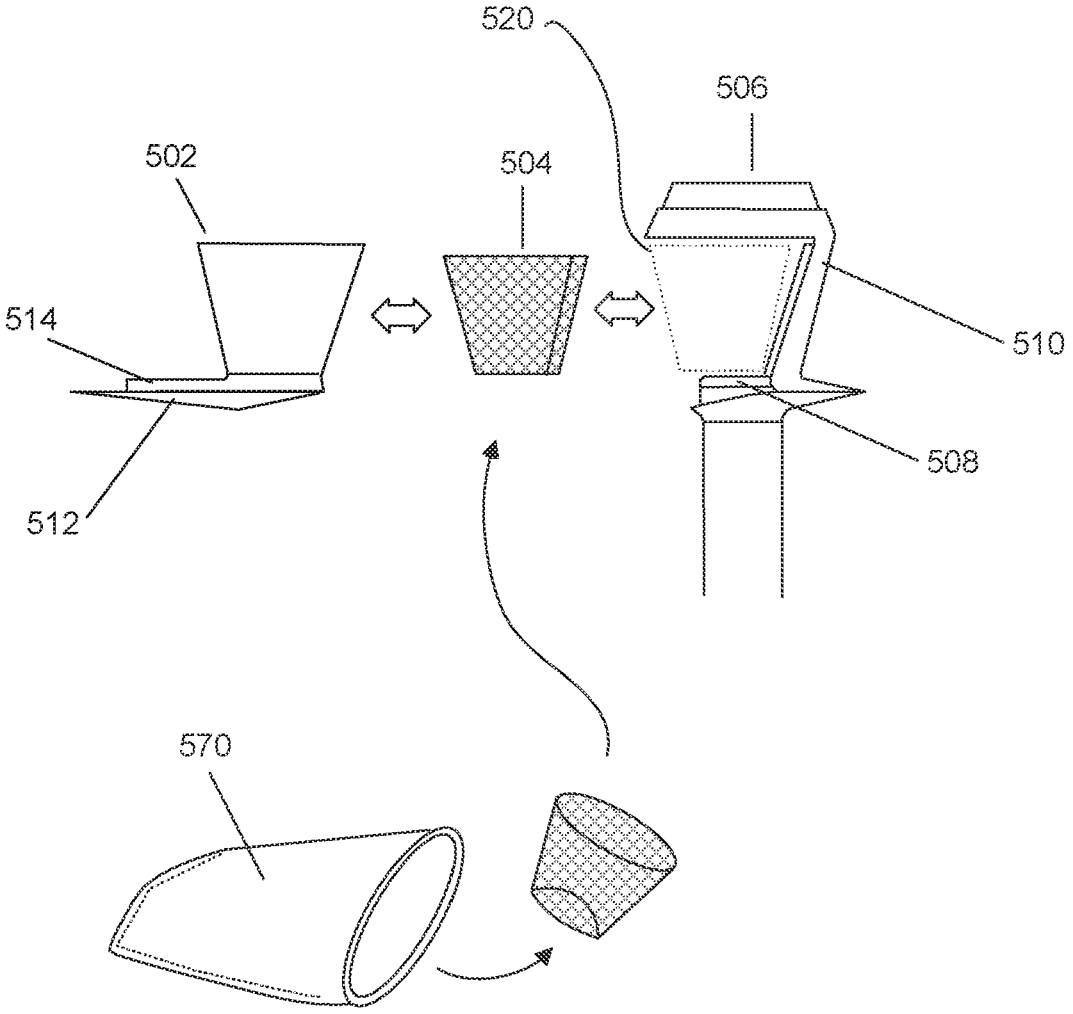
FIG. 5A is a perspective view of an exemplary embodiment of a heater and capsule, according to a disclosed embodiment.

FIG. 5A is a perspective view of an exemplary embodiment of a heater and capsule, according to a disclosed embodiment. In this alternative embodiment, a capsule cup 502 and mesh capsule 504 integrate chamber 205 and capsule 300. As shown in FIG. 5A, mesh capsule 504 may be formed with a meshed container. For example, in some embodiments cup 502 may be formed with folded and/or soldered metallic wires. In addition, mesh capsule 504 may be stackable or may include materials different from metal such as plastics. Mesh capsule 504 may hold contents similar to the ones described for capsule 300, and it may have a plurality of shapes. In addition, mesh capsule 504 may be disposable or reusable.

In some embodiments, capsule cup 502 and mesh capsule 504 may have complementary shapes. For example, mesh capsule 504 may fit inside capsule cup 502. In such embodiments, capsule cup 502 may have a generic shape, such as a cylinder or prism. In other embodiments, capsule cup 502 may have a specific or unique shape such as a leaf or a toroid. Capsule cup 502 may be configured to only receive mesh cup 504 if mesh cup 504 is authentic and has the precise complementary shape. This feature may be used to guarantee mesh cup 504 is fabricated for capsule cup 502. Furthermore, precise matching of capsule cup 502 and mesh capsule 504 may be required before hookah 100 is operated. For example, bottom heater 508 may be configured to operate only when mesh capsule 504 matches capsule cup 502. Thus, mesh capsule 504 may act as a 'key' to operate hookah 100 warranting that mesh capsule 504 is authentic. In addition to complementary shapes, authenticity of mesh capsule 504 may also be determined with sensors in capsule cup 502. For example, weight sensors, barcode readers, and/or capacitive sensors positioned in capsule cup 502 may be used to determine the authenticity of mesh capsule 504.

Furthermore, in embodiments presented in FIG. 5A, capsule cup 502 may additionally have a complementary shape to an open heater apparatus 510. Open heater apparatus 510 may have similar components and functions to heating apparatus 200 but may not have the closed chamber 205 or the top and bottom pieces. Open heater apparatus 510 may include open top heater 506 and open bottom heater 508. These heaters may replicate top heaters 204 and bottom heater 202 and may also incorporate temperature sensors, but are not attached to the top and bottom pieces. Additionally, open heaters may secure capsule cup with hooks or magnetic components.

Open heater apparatus 510 may include capsule cavity 520. Capsule cavity 520 may have a complementary shape to capsule cup 502 and be configured to determine the authenticity of capsule cup 502. For example, capsule cavity 520 may have specific shapes that only receive an authentic capsule cup 502. Additionally, capsule cavity 520 may include sensors (not shown) that may be used to determine the authenticity of capsule cup 502. For example, capsule cavity 520 may include weight sensors, barcode readers, and/or capacitive sensors may be used to determine the authenticity of capsule cup 502. In such embodiments, hookah 100 may only operate if capsule cup 502 is determined to be authentic and matches the shape and size of capsule cavity 520.

Capsule cup 502 may include a capsule handle 512 and a capsule tray 514. The capsule handle 512 may be an elongated piece attachable to capsule cup 502 that facilitates handling. For example, capsule handle 512 may be made of a thermal insulating material so a user can manipulate the capsule even if it is hot. In some embodiments, capsule handle 512 may be part of capsule cup 502 but in other embodiments it may be a separate disposable or reusable piece. In other embodiments, capsule tray 514 may be used to insert or move capsule 502. In such embodiments, capsule tray 514 may be attached to both capsule cup 502 and capsule handle 512. Alternatively, capsule tray 514 may be an independent piece with a shape that is complementary to capsule cup 502. In some embodiments, capsule tray 514 may be made of a material with poor thermal conductivity, such as a ceramic or plastic. In such embodiments, the capsule handle 512 may be made of rigid materials like metals or ceramics. Furthermore, in some embodiments, capsule cup 502 may be packaged in bag 570. Bag 570 may be vacuum sealed and disposable. Bag 570 may hold a single cup 502 or a plurality of cups. In embodiments, in which multiple cups are in Bag 570, a variety of capsule cups may be arranged in bag 570. For example, bag 570 may be a shaped box in which capsule cups are fitted inside grooves or indentations of the box.

Figure 5B:
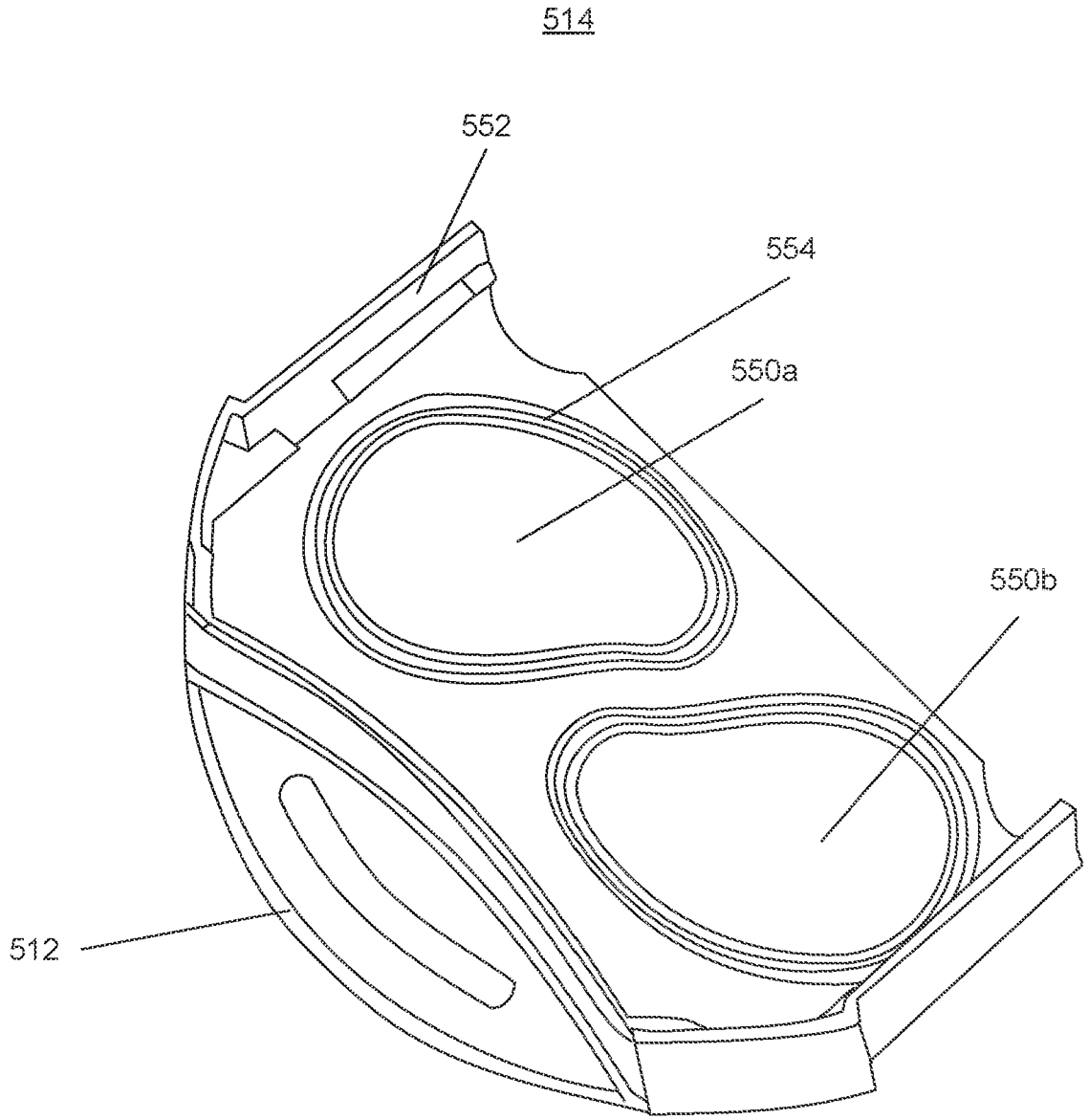
FIG. 5B is a perspective view of an exemplary embodiment of a capsule tray, according to a disclosed embodiment.

FIG. 5B is a perspective view of an exemplary embodiment of a capsule tray 514, according to a disclosed embodiment. Capsule tray 514 may be attached to capsule handle 512, which may include a grove to facilitate handling. Capsule tray may include a plurality of slots 550*a* and 550*b*. Capsule tray 514 with a single slot and more than two slots are also contemplated. In some embodiments, slots 550 may have a complementary shape to the one of capsule 300 so they fit in capsule tray 514. In some embodiments, to minimize cost, only the vicinity of slots 550 may be formed with a non-conductive material 554. Non-conductive material 554 may include ceramics and polymers. Because capsule 300 will be hot after a smoking session, non-conductive material 554 may prevent heating of the full capsule tray 514 and thus minimize burning risks. Alternatively, all capsule tray 514 may be made of a non-conductive material. In addition, capsule tray 514 may include loading guides 552. Loading guides 552 may fit in guides on open heater apparatus 510 to facilitate loading of the capsules. In some embodiments capsule tray 514 may be fabricated with a disposable material but in alternative embodiments capsule tray 514 may be part of hookah 100. In such embodiments, capsule tray 514 may be attached to hookah 100 and include a hinge or a fastener.

Figure 6:
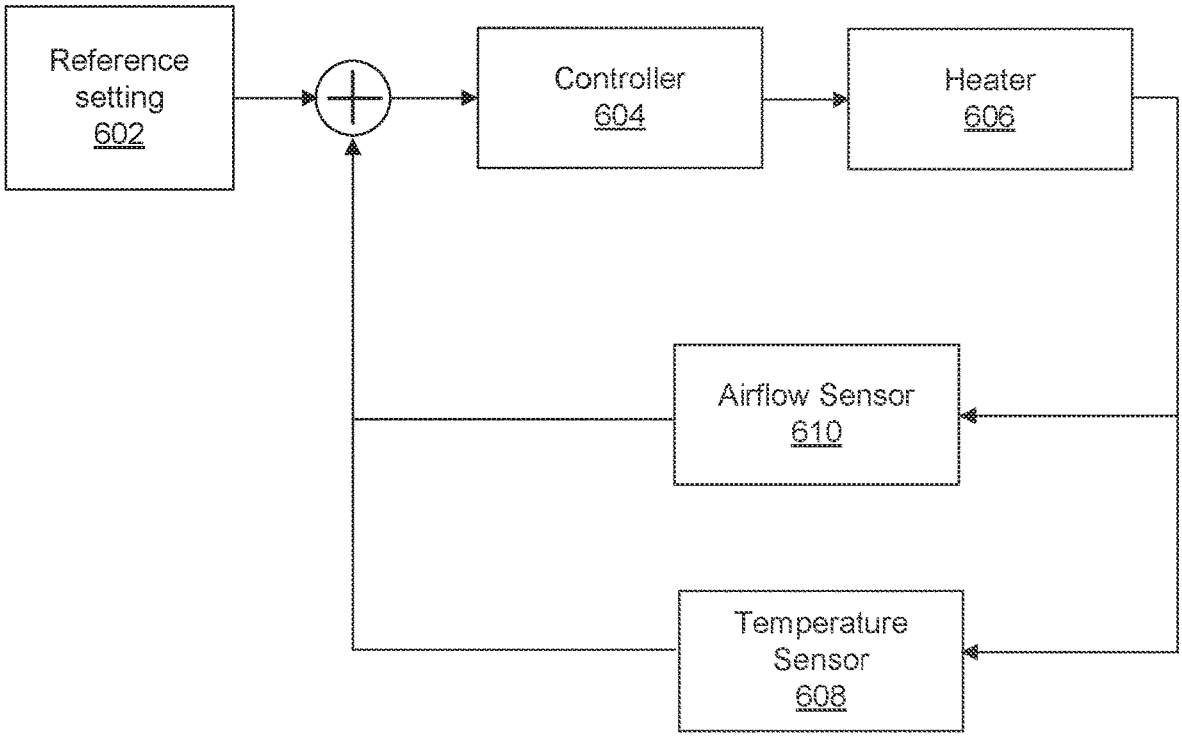
FIG. 6 is an exemplary block diagram of elements in the hookah system according to a disclosed embodiment.

FIG. 6 is an exemplary block diagram of elements in the hookah system according to a disclosed embodiment. The hookah system may include a reference setting 602. Reference setting 602 may have a user interface in which the user can set preferences or parameters. For example, in some embodiments reference setting 602 may be a display with buttons that enables selection of a temperature. In other embodiments, reference setting 602 may be a circuit that automatically sets the reference value. Alternatively, reference setting 602 may be hardware that generates or control an electrical signal. For example, reference setting 602 may be a dial or a potentiometer adjusting a voltage.

FIG. 6 also presents controller 604. Controller 604 may include any appropriate type of general-purpose or special purpose microprocessor, digital signal processor, or microcontroller. Controller 604 may be configured to receive a process information from reference setting 602 and sensors in hookah 100.

Controller 604 may be configured to receive data and/or signals from components such as heater 606, temperature sensor 608, and air flow sensor 610 and process the data and/or signals to determine one or more conditions. For example, controller 604 may receive the signal generated by airflow sensors 610 via, for example, an I/O interface. As described in more detail below, controller 604 may also receive information regarding the motion and/or operation status of heaters 606 from temperature sensors 608 via, for example, a communication interface. Controller 604 may further generate and transmit a control signal for actuating one or more components, such as heaters 606 and/or associated power electronics.

Heater 606 may represent elements, either individually or simultaneously, such as bottom heater 202, top heater 204, and holding heater 232. In addition, temperature sensors 608 may represent elements such as bottom sensor 212, top sensor 214 and/or air inlet sensor 216. FIG. 6 additionally presents airflow sensor 610. In some embodiments airflow sensor may include a hot/cold wire sensor, a Karmax vortex sensor, and/or a membrane sensor. In other embodiments, airflow sensor 610 may include laminar flow elements. In yet other embodiments, airflow sensor 610 may be specific temperature sensors with configurations for airflow detection.

Figure 7:
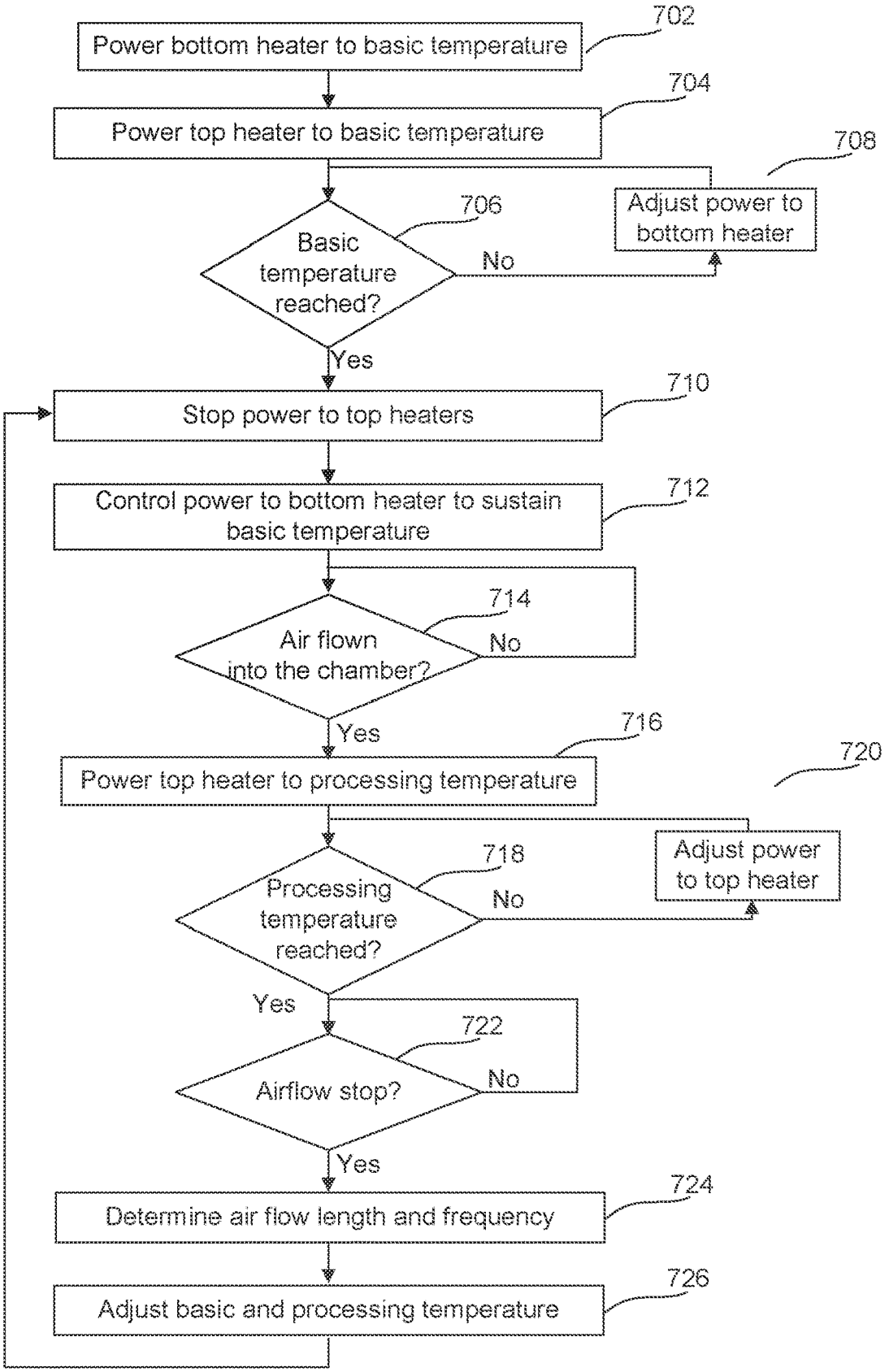
FIG. 7 is a flowchart of an exemplary process for heating a chamber, consistent with embodiments of the present disclosure.

FIG. 7 is a flowchart of an exemplary process for heating a chamber, consistent with embodiments of the present disclosure. Heating process 700 describes steps to heat chamber 205 and discloses steps taken by controller 604 during a session.

In step 702, controller 604 may deliver a default power to bottom heater 202. In embodiments, in which bottom heater 202 is an inductive heater, controller 604 may set the voltage amplitude and frequency to default values in step 702.

Additionally, the default power may be set by the user or may be stored in a memory device connected to controller 604.

In step 704, controller 604 may also power top heater 204 and/or holding heater 232 to a basic temperature. A basic temperature may be a few degrees below vaporization or reaction of the material inside chamber 205. For example, a basic temperature may be in the range of 110 to 250° C. The basic temperature may depend on the components of the material inside chamber 205; for example, oils or sugars may have a lower basic temperature than leaf tobacco, which would have a different basic temperature entirely when compared to other smokable materials, aromatic substances such as air fresheners, medicinal substances, or other botanical vaporizers.

In some embodiments, the basic temperature may be a function of the reaction temperature. For example, controller 604 may determine the basic temperature as a fraction of the reaction temperature and set the basic temperature as a percentage of the reaction temperature. In addition, the basic temperature may be selected only a few degrees below the processing temperature to minimize transitions between basic and processing temperature. Moreover, the basic temperature may also be a function of the amount of substance in the chamber. For example, while the basic temperature may be set low to prevent overheating when the substance volume is small, a larger basic temperature may be selected when the volume of substance is high to facilitate changes between basic and processing temperatures. Controller may identify the volume of substance by reading identity tag 328, or with additional sensors that determine volume or mass in chamber 205. In other embodiments the basic temperature may be defined by the user, for example, by entering the desired temperature in display 140 or adjusting buttons 126. In yet other embodiments, the basic temperature may be a function of a drag profile or information from other sensors. For example, the basic temperature may be adjusted depending on an identified drag profile or may be adjusted based on information from carbon monoxide detector 132.

In some embodiments, in which capsule 300 includes a plurality of substances, controller 604 may determine basic and reaction temperatures based on the substances in the capsule and their relative quantity. For example, when capsule 300 contains elements with disparate processing temperatures controller 604 may calculate an intermediate processing temperature. In other embodiments, however, controller 604 may select the highest or the lowest temperatures of the plurality of substances.

In step 706 controller 604 may query temperature sensors to determine if the basic temperature has been reached. For example, controller 604 may get readings from bottom sensors 212 to determine if the temperature is in the basic temperature range. In other embodiments, controller 604 may take multiple measurements and compute the averages to estimate chamber 205 temperature. Other computations of sensor data, such as median or model functions, may also be used to estimate the temperature in chamber 205. In yet other embodiments, controller 604 may query air flow sensors to determine the temperature in chamber 205. For example, controller 604 may correlate the air flow to a temperature in chamber 205.

When controller 604 determines that the basic temperature has not been reached (step 706: No), controller 604 may continue to step 708 and adjust the power delivered to the bottom heater. In some embodiments, it may adjust power by ramping up the power with a defined slope. In other embodiments, it may adjust the power with predetermined sequence of increments. For example, it may increase the voltage by adding an exponential decay. Alternatively, controller 604 may adjust the power by modifying the delivered frequency to the heater.

When controller 604 determines that a basic temperature has been reached (step 706: Yes), it may continue to step 710. In step 710 controller 604 may stop powering top heater 204 and holding heater 232, to prevent overheating and unintended vaporization. During the initial heating of the chamber, for example from room temperature to 200° C., it may be necessary to heat with all heaters available to minimize waiting time. However, once the basic temperature is reached, the additional heaters may waste power and cause unintended vaporization.

In step 712, controller 604 may utilize sensor information to maintain the basic temperature. For example, a basic temperature set with reference setting 602 may be the reference temperature. As exemplified in FIG. 6, controller 604 may use information from sensors and use on/off or proportional-integral-derivative (PID) control circuits to hold chamber 205 at the basic temperature.

Controller 604 may determine if air is being flown into the chamber in step 714. Controller 604 may make this determination based on temperature information from, for example, bottom sensor 212 and top sensor 214. In alternative embodiments, controller 604 may determine air flow by querying air flow sensor 610. When no air is being flown into the chamber (step 714: No), the controller may start an iterative querying process. It may interrogate sensors during specific periods, for example it may interrogate the sensors every 100 ms, or it may utilize interruption routines similar to the ones used in microcontrollers which trigger a callback function in the firmware. However, when controller 604 determines that air is being flown into the chamber (step 714: Yes), controller 604 may continue to step 716 and power the top heater to a processing temperature. The processing temperate may be a temperature in which the vaporization reaction occurs, hence it may also be defined as a reaction temperature. For example, the processing temperature may be a temperate between 250 and 350° C. The processing temperature may be dependent on the contents of capsule 300. For example, tobacco may have a higher processing temperature than herbs or oils.

Table 1 presents exemplary contents that may be in capsule 300 and associates them with processing temperature ranges. In some embodiments controller 604 may select the processing temperature based on the contents of capsule 300. For example, controller 604 may determine the contents of capsule 300 by reading identity tag 328, or receiving instructions via display 140, and then determine the processing temperature based on the contents of capsule 300. The processing temperature may be individually selected for the specific content of the capsule (e.g. tobacco temperature), or may be selected for a group of contents with low, medium, or high temperatures. For example, controller 604 may determine that the content is tobacco, select a specific processing temperature between 125° C. to 150° C. (257° F. to 302° F.), and calculate a basic temperature as a percentage of the processing temperature. Alternatively, controller 604 may only identify that the capsule 300 contains a substance from a group of temperatures. For instance, controller 604 may determine that the capsule contains a substance that requires a high processing temperature between 175° C. to 200° C. (347° F. to 392° F.) without identifying the specific substance. In such embodiments, substances such as tobacco, yerba mate, or lemongrass may all be classified in low processing temperature (between 100° C. to 125° C.), substances like guarana and sweet flag may be classified in medium processing temperatures (150° C. to 175° C.), and substances like salvia divinorum and ginger may be grouped in high processing temperatures (175° C. to 200° C.).

TABLE 1

Processing temperatures.

| Capsule Content | Processing Temperature |
|---|---|
| Low processing temperature | |
| Blue Lotus | 100° C. to 125° C. (212° F. to 257° F.) |
| Chamomile | 100° C. to 125° C. (212° F. to 257° F.) |
| Clove | 125° C. to 150° C. (257° F. to 302° F.) |
| Gotu Kola | 100° C. to 150° C. (212° F. to 302° F.) |
| Lavender | 100° C. to 125° C. (212° F. to 257° F.) |
| Lemongrass | 100° C. to 125° C. (212° F. to 257° F.) |
| Passionflower | 100° C. to 150° C. (212° F. to 302° F.) |
| Inebriating mint (*Lagochilus inebrians*) | 100° C. to 150° C. (212° F. to 302° F.) |
| Pink lotus (*Nelumbo nucifera*) | 100° C. to 125° C. (212° F. to 257° F.) |
| St. John's Wort | 100° C. to 150° C. (212° F. to 302° F.) |
| Syrian Rue (*Peganum harmala*) | 100° C. to 150° C. (212° F. to 302° F.) |
| Thyme | 100° C. to 150° C. (212° F. to 302° F.) |
| Tobacco | 125° C. to 150° C. (257° F. to 302° F.) |
| Tranquilitea | 100° C. to 150° C. (212° F. to 302° F.) |
| Wild Lettuce | 125° C. to 150° C. (257° F. to 302° F.) |
| Wormwood | 100° C. to 150° C. (212° F. to 302° F.) |
| Yerba Mate | 100° C. to 150° C. (212° F. to 302° F.) |
| Medium processing temperature | |
| Aphrodite Mix | 150° C. to 175° C. (302° F. to 347° F.) |
| Coffee beans | 150° C. to 175° C. (302° F. to 347° F.) |
| Damiana | 150° C. to 175° C. (302° F. to 347° F.) |
| *Ephedra* | 125° C. to 175° C. (257° F. to 347° F.) |
| Fennel | 150° C. to 175° C. (302° F. to 347° F.) |
| *Ginkgo* | 125° C. to 175° C. (257° F. to 347° F.) |
| Guarana | 125° C. to 175° C. (257° F. to 347° F.) |
| Klip Dagga | 150° C. to 175° C. (302° F. to 347° F.) |
| Lion's Tail (Wild Dagga) | 150° C. to 175° C. (302° F. to 347° F.) |
| Marihuanilla | 150° C. to 175° C. (302° F. to 347° F.) |
| Mexican Tarragon | 150° C. to 175° C. (302° F. to 347° F.) |
| *Papaver Somniferum* | 125° C. to 175° C. (257° F. to 347° F.) |
| Sweet Flag | 150° C. to 175° C. (302° F. to 347° F.) |
| White Lilly | 125° C. to 175° C. (257° F. to 347° F.) |
| High processing temperature | |
| *Aloe Vera* | 175° C. to 200° C. (347° F. to 392° F.) |
| Betel nut | 185° C. to 200° C. (365° F. to 392° F.) |
| *Calea Zacatechichi* | 185° C. to 200° C. (365° F. to 392° F.) |
| Clavo Huasca | 175° C. to 200° C. (347° F. to 392° F.) |
| *Galangal* | 150° C. to 200° C. (302° F. to 392° F.) |
| Garlic | 175° C. to 200° C. (347° F. to 392° F.) |
| Ginger | 175° C. to 200° C. (347° F. to 392° F.) |
| Ginseng | 175° C. to 200° C. (347° F. to 392° F.) |
| Green tea Gunpowder | 175° C. to 185° C. (347° F. to 365° F.) |
| Hops | 175° C. to 200° C. (347° F. to 392° F.) |
| Kanna (UB40 vaporizer extract) | 188° C. (370° F.) |
| Kava | 175° C. to 200° C. (347° F. to 392° F.) |
| Kola Nut | 185° C. to 200° C. (365° F. to 392° F.) |
| Kra Thom Khok (*Mitragyna hirsuta*) | 175° C. to 185° C. (347° F. to 365° F.) |
| Kratom | 175° C. to 200° C. (347° F. to 392° F.) |
| Maca Root | 150° C. to 200° C. (302° F. to 392° F.) |
| Maconha Brava | 175° C. to 200° C. (347° F. to 392° F.) |
| Marshmallow | 150° C. to 200° C. (302° F. to 392° F.) |
| *Mimosa hostilis* | 170° C. to 190° C. (338° F. to 374° F.) |
| Morning Glory | 185° C. to 200° C. (365° F. to 392° F.) |
| Muira Puama | 175° C. to 200° C. (347° F. to 392° F.) |
| Mulungu | 175° C. to 200° C. (347° F. to 392° F.) |
| Sakae Naa (*Combretum quadrangulare*) | 175° C. to 185° C. (347° F. to 365° F.) |
| *Salvia Divinorum* | 210° C. to 230° C. (410° F. to 446° F.) |
| Sinicuichi (Mayan Sun Opener) | 175° C. to 200° C. (347° F. to 392° F.) |
| Valerian | 185° C. to 200° C. (365° F. to 392° F.) |
| Yohimbe | 185° C. to 200° C. (365° F. to 392° F.) |
| *Aloe Vera* | 175° C. to 200° C. (347° F. to 392° F.) |
| Betel nut | 185° C. to 200° C. (365° F. to 392° F.) |
| *Calea Zacatechichi* | 185° C. to 200° C. (365° F. to 392° F.) |

TABLE 1-continued

Processing temperatures.

| Capsule Content | Processing Temperature |
|---|---|
| Clavo Huasca | 175° C. to 200° C. (347° F. to 392° F.) |
| *Galangal* | 150° C. to 200° C. (302° F. to 392° F.) |
| Garlic | 175° C. to 200° C. (347° F. to 392° F.) |

In some embodiments, controller 604 may only power the top heaters during specific periods of time and it may rotate power between multiple top heaters with a sequence. The sequence may include time intervals or determinations based on air flow and temperature. For example, the sequence may be based on a clock and a loop routine in which an independent top heater is powered in every cycle. A second sequence method may be based on top sensors 204. Controller 604 may change the power delivered to heaters when it detects a temperature above a threshold. Additionally, the user may trigger the power changes or sequences with a manual power control and elements like buttons 126.

In some embodiments, the reaction or processing temperature may be achieved with heated air flowing through air inlets 206. In such embodiments, top heaters 204 may heat air that is flowing to chamber 205 instead of directly heat chamber 205. The hot air may increase the temperature in the chamber from the basic to the processing temperature and result in combustion of the material in capsule 300. For example, top heater 204 inside one air inlet 206 may be configured to heat up passing air. Heating air instead of directly placing the heat source on the material, may result in a more uniform reaction because heat is evenly distributed in the entire material instead of localized points.

In step 716 controller 604 may frequently monitor temperature sensors to determine if capsule 300 is being overheated. In such embodiments, controller 604 may be able to reduce power when, for example, a threshold temperature is reached. To prevent overheating and unintended burning of contents in capsule 300, controller 604 may determine threshold temperatures that trigger reduction of the power to top heater 204 and bottom heater 202. For example, if controller 604 determines that the temperature in chamber 205 is a 120% of the processing temperature, it may determine that the capsule is being overheated and may reduce the power delivered to the heaters. In other embodiments, controller 604 may make the determination that the capsule is being overheated based on other sensors in hookah 100. For example, controller 604 may query monoxide detection 132 to determine if an abnormal reading is indicative of excessive heating. Prevention of overheating may be particularly important when top and bottom heaters use inductive heating principles that can quickly increase the temperature of capsule 300 and require overheating prevention measures.

In step 718, controller 604 may interrogate sensors to determine if the processing temperature has been reached. In a similar process to the determination done in step 706, controller 604 may do this process by querying at least one of a plurality of sensors in heating apparatus 200. When the processing temperature has not been reached (step 718: No), controller 604 may adjust the power to the top heater. However, when controller 604 determines that processing temperature was reached (step 718: Yes), it may continue to step 722. Step 722 is similar to step 714 and includes querying sensor to determine if air is flown into chamber 205. If controller 604 determines that the air flow continues, it may continue querying temperature sensors or it may enter in an interruption routine. However, if controller 604 determines that the air flow has stopped (step 722: Yes) it may proceed to step 724 and determine the air flow length and frequency.

Figure 8:
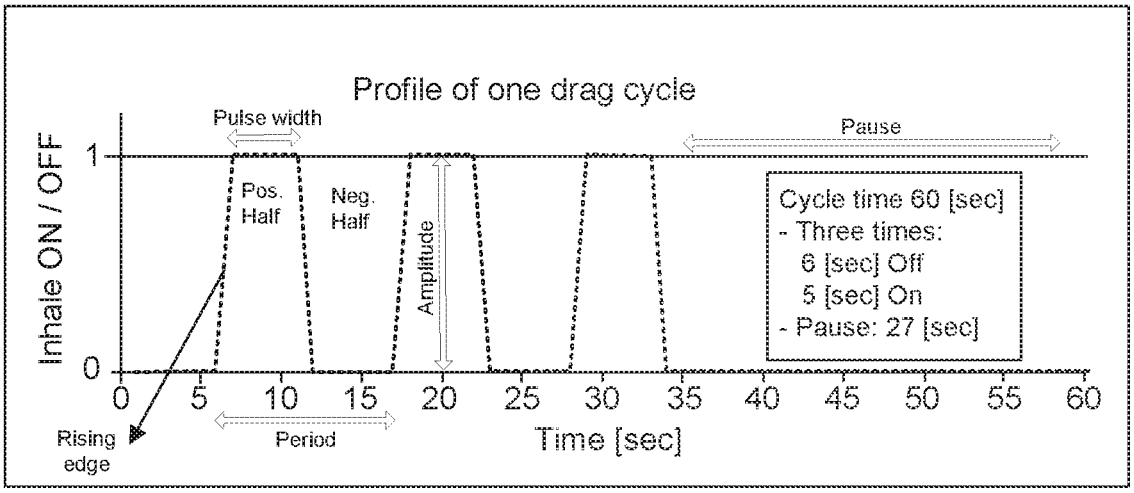
FIG. 8 is an exemplary plot of inhale cycles as a function of time, consistent with the present disclosure.

In step 724 controller 604 may create a drag profile based on the air flow information. The drag profile may include an inhale frequency, an inhale peak and/or an amplitude. The drag profile may also include a resting period and may be described with positive half and negative half intervals. Additionally, the inhale profile may include information of the rising edge, falling edge, and/or pulse width. FIG. 8 is an exemplary plot of a drag profile.

In step 726, and based on the drag profile determined in step 724, controller 604 may adjust the basic and processing temperatures used in steps 706 and 718 therefore adjusting the power delivered the each one of the heaters. In some embodiments, controller 604 may determine that the drag profile has a higher than usual frequency. For example, the drag period may be of less than 2 s. In such embodiments, controller 604 may decrease the processing temperature, for example by modifying the reference setting 602, to prevent fast combustion of the substance in chamber 205. Similarly controller 604 may also reduce reference setting 602, if the drag profile has long pulse widths, which may over heat chamber 205. Also, in alternative scenarios, in which the pulse width is too short or the inhale amplitude is low, controller 604 may determine to increase the processing temperature to facilitate combustion of the material.

FIG. 8 is an exemplary plot of inhale cycles as a function of time, consistent with the present disclosure. It presents a model drag profile that may be recorded by controller 604 during a session. Data from an inhale may be recorded in a memory device in controller 604 and can be aggregated to create a drag pattern. For instance, controller 604 may collect 60 s of information and generate a one minute pattern. Data analysis techniques such as Fast Fourier Transforms, Time Waveform, and/or heterodyne wave analysis may be used to determine variables such as frequency and amplitude from the data collected from sensors during the air flow process. Data may be collected in a memory device in controller 604 and may represent amplitude vs. time as described in FIG. 8.

Embodiments and examples discussed so far have mainly described the combustion of materials, like tobacco or shisha, in chamber 205 or capsule 300. However, heating apparatus 200, other elements of hookah 100, and capsule 300 may be used for other heating processes that do not involve vaporization or combustion. For example, basic and processing temperatures may be adjusted to have heating apparatus 200 cook food. Then, the capsule may have alternate shapes, size, and dimensions or include new elements to accommodate for example rice or vegetables. Also, materials of heater apparatus 200 and capsule 300 may be selected so they can be used in food processing equipment. In addition, heating apparatus 200 may be used for environment heating. For example, volume of chamber 205 and the size of air outlets 208 may be modified to have heater apparatus 200 as the heat source of a central heating system. Furthermore, heater apparatus 200 may be additionally be used in chemical processes such as polymer curation or metal annealing by modifying materials, heaters, and protocols.

Another aspect of the disclosure is directed to a non-transitory computer-readable medium storing instructions which, when executed, cause one or more processors to perform the methods, as discussed above. The computer-readable medium may include volatile or non-volatile, magnetic, semiconductor, tape, optical, removable, non-removable, or other types of computer-readable medium or computer-readable storage devices. For example, the computer-readable medium may be the storage unit or the memory module of controller 604 having the computer instructions stored thereon, as disclosed. In some embodiments, the computer-readable medium may be a disc or a flash drive having the computer instructions stored thereon.

It will be apparent to those skilled in the art that various modifications and variations can be made to the heating apparatus and the related methods. Other embodiments will be apparent to those skilled in the art from consideration of the specification and practice of the disclosed heating apparatus and related methods. It is intended that the specification and examples be considered as exemplary only, with a true scope being indicated by the following claims and their equivalents.

What is claimed is:

1. A method of heating a smokable material inside a chamber, the method comprising:

heating the smokable material to a basic temperature with a first heater in the bottom of the chamber, the first heater being in physical contact with a first temperature sensor;

heating air flowing through a first air inlet connected to the top of the chamber with a second heater, the second heater being positioned inside the first air inlet;

heating air flowing through a second air inlet connected to the top of the chamber with a third heater, the second air inlet being parallel to the first air inlet, the third heater being positioned inside the second air inlet; and heating the smokable material to a processing temperature with the heated air, wherein the first air inlet and the second air inlet are in fluid communication with a mouth piece.

2. The method of claim 1, wherein the second heater comprises one or more independent heating elements.

3. The method of claim 2, wherein the one or more independent heating elements are powered in a sequence based on at least one of a period of time, an air flow pattern, and a manual power control.

4. The method of claim 1, wherein heating the smokable material to a basic temperature, further comprises:

powering on the second heater and the third heater to the basic temperature; and powering off the second heater when the material reaches the basic temperature.

5. The method of claim 1, wherein the first heater is an inductive heater and comprises a coiled conductor.

6. The method of claim 5, wherein the inductive heater further comprises a dielectric core comprising at least one of a ceramic, a plastic, or a ferroelectric material.

7. The method of claim 1, further comprising:

determining air is being flowed into the chamber; and adjusting the second heater temperature and the third heater temperature when air is being flown into the chamber.

8. The method of claim 7, further comprising:

adjusting the basic temperature and the processing temperature based on at least one of a frequency and a length of air flow into the chamber.

9. The method of claim 1, wherein the second heater is parallel to the third heater; and the chamber comprises an air outlet in fluid communication with the mouth piece.

10. The method of claim 1, wherein heating air flowing through the first air inlet comprises:

determining whether air is being flowed into the chamber by querying an airflow sensor; and powering on the second heater and the third heater to the processing temperature in response to determining air is being flowed into the chamber.

11. The method of claim 10, wherein heating air flowing through the first air inlet further comprises:

determining whether air stopped being flowed into the chamber by querying the airflow sensor; and powering off the second heater and the third heater.

12. The method of claim 1, wherein heating air flowing through the first air inlet comprises:

generating a drag profile by determining air flow frequency; and adjusting the basic temperature and the processing temperature based on the drag profile by adjusting power delivered to the first heater, the second heater, and the third heater.

13. The method of claim 12, wherein adjusting the basic temperature comprises modifying a reference setting.

14. The method of claim 12, wherein the drag profile comprises an inhale frequency, an inhale peak, and an inhale amplitude.

15. The method of claim 1, wherein the basic temperature is lower than the processing temperature.

16. The method of claim 15, wherein the basic temperature is between 110° C. and 250° C.; and the processing temperature is between 250° C. and 350° C.

17. The method of claim 1, wherein heating the smokable material comprises:

identifying the smokable material by reading an identity tag in a capsule containing the smokable material; and determining the basic temperature and the processing temperature based on the identified smokable material.

18. A method of heating comprising:

heating a material inside a chamber to a basic temperature with a first heater in the bottom of the chamber, the first heater being in physical contact with a first temperature sensor;

heating air flowing through a first air inlet connected to the top of the chamber with a second heater, the second heater being positioned inside the first air inlet;

heating air flowing through a second air inlet connected to the top of the chamber with a third heater, the second air inlet being parallel to the first air inlet, the third heater being positioned inside the second air inlet; and heating the material to a processing temperature with the heated air.

* * * * *